US010129647B2

(12) United States Patent
Seo et al.

(10) Patent No.: US 10,129,647 B2
(45) Date of Patent: Nov. 13, 2018

(54) WIRELESS SOUND EQUIPMENT

(71) Applicant: LG ELECTRONICS INC., Seoul (KR)

(72) Inventors: Sangwoo Seo, Seoul (KR); Hongyi Song, Seoul (KR); Hyunsun Yoo, Seoul (KR); Hyungwoo Park, Seoul (KR); Jaeseok Ho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/596,831

(22) Filed: May 16, 2017

(65) Prior Publication Data

US 2017/0347192 A1 Nov. 30, 2017

Related U.S. Application Data

(60) Provisional application No. 62/341,090, filed on May 25, 2016.

(30) Foreign Application Priority Data

Nov. 24, 2016 (KR) ..... 10-2016-0157167
Dec. 23, 2016 (KR) ..... 10-2016-0177706
Jan. 11, 2017 (KR) ..... 10-2017-0004014

(51) Int. Cl.
*H04R 5/02* (2006.01)
*H04R 5/04* (2006.01)
(Continued)

(52) U.S. Cl.
CPC ..... *H04R 5/02* (2013.01); *H04R 1/1016* (2013.01); *H04R 1/1033* (2013.01); *H04R 1/403* (2013.01);
(Continued)

(58) Field of Classification Search
CPC ..... H04R 5/02; H04R 1/1016; H04R 1/1033; H04R 1/403; H04R 5/04; H04R 2201/107;
(Continued)

(56) References Cited

U.S. PATENT DOCUMENTS 8,184,846 B1 * 5/2012 Craine ..... H04R 27/00 368/322
8,934,654 B2 * 1/2015 Fullam ..... H04R 1/028 381/381
(Continued)

FOREIGN PATENT DOCUMENTS

EP 2 700 907 A2 2/2014
EP 2 733 956 A2 5/2014
(Continued)

*Primary Examiner* — Andrew L Sniezek
(74) *Attorney, Agent, or Firm* — Birch, Stewart, Kolasch & Birch, LLP

(57) ABSTRACT

There is disclosed a wireless sound equipment including a body which is wearable on a user's body, a first hole formed in an upper portion of the body, a second hole formed in a lower portion of the body toward the user's body when the user wears the wireless sound equipment, a first speaker configured to output sound via the first hole, and a second speaker configured to output sound via the second hole.

28 Claims, 25 Drawing Sheets

(51) Int. Cl.
*H04R 1/40* (2006.01)
*H04R 1/10* (2006.01)

(52) U.S. Cl.
CPC ..... *H04R 5/04* (2013.01); *H04R 2201/107* (2013.01); *H04R 2420/07* (2013.01)

(58) Field of Classification Search
CPC ..... H04R 2420/07; H04R 1/323; H04R 2201/023
See application file for complete search history.

(56) References Cited

U.S. PATENT DOCUMENTS

| | | | | |
|---|---|---|---|---|
| 2011/0228959 | A1 | 9/2011 | Meehan et al. | |
| 2013/0072834 | A1 | 3/2013 | Afshar | |
| 2013/0256345 | A1 | 10/2013 | Larkin | |
| 2014/0233752 | A1 | 8/2014 | Seo et al. | |
| 2014/0270321 | A1 | 9/2014 | Fullam | |
| 2014/0369541 | A1 | 12/2014 | Miskin et al. | |
| 2016/0286299 | A1* | 9/2016 | Anderson ..... | H04R 1/1016 |

FOREIGN PATENT DOCUMENTS

| | | | |
|---|---|---|---|
| EP | 2770704 | A1 | 8/2014 |
| EP | 2919482 | A2 | 9/2015 |
| JP | 5-552 | A | 1/1993 |
| JP | 3198509 | B2 | 8/2001 |
| JP | 2008-263374 | A | 10/2008 |
| JP | 2015-95868 | A | 5/2015 |
| JP | 2017-50749 | A | 3/2017 |
| KR | 10-2015-0143277 | A | 12/2015 |
| WO | WO 2005/053351 | A1 | 6/2005 |
| WO | WO 2015/022817 | A1 | 2/2015 |

* cited by examiner (a)

FIG. 18

| | | Slide ⇄ | Short • | double • • | long ▬ |
|---|---|---|---|---|---|
| 2711 | Play | | Play/pause | EQ change | |
| 2713b | Next | | Play Next File | | Current Time |
| 2713a | Prev. | | Play Prev. file | | Battery info. |
| 2712 | Call | | Call / End call | Speed Dial | Last Number Redial |
| 2714c | Mute | | Mute | | |
| 2714b | Vol - | Volume down | | | |
| 2714a | Vol + | Volume up | | | |
| 2716 | Power | Power ON/OFF | | | |
| 2717 | Sound Mode | Speaker/Earbud | | | |

(a)

(b)

WIRELESS SOUND EQUIPMENT

CROSS-REFERENCE TO RELATED APPLICATIONS

This application claims priority to U.S. Patent Application No. 62/341,090 filed on May 25, 2016, and Korean Patent Application Nos. 10-2016-0157167 filed on Nov. 24, 2016, 10-2016-0177706 filed on Dec. 23, 2016 and 10-2017-0004014 filed on Jan. 11, 2017, the entire contents of all of which are hereby incorporated by reference in their entireties.

BACKGROUND OF THE DISCLOSURE

Field of the Disclosure

Embodiments of the present disclosure relate to wireless sound equipment which receives a sound signal from a terminal and transmit a control signal for controlling the terminal by wireless communication with the terminal.

Background of the Disclosure

Sound equipment means the audio device which is able to receive a sound signal from a terminal and transmit the audio information collected via a microphone to the terminal. Typically, the wire type portable sound equipment is commonly used and it is connected to an ear jack of a terminal to receive a sound signal. In recent, there are increasing demands for the wireless communication type wireless sound equipment in aspects of mobility and user convenience.

The wireless sound equipment having a design considering mobility is under development and examples of the wireless sound equipment having such the design include band-shaped headphone type wireless sound equipment, ear wearable type wireless sound equipment and ear inserting type wireless sound equipment. The band-shaped headphone type is worn on a user's head and facilitates the user's carrying. The band-shaped headphone type is worn on a user's head and facilitates the user's carrying. The wireless sound equipment facilitates music appreciation and the wearable wireless sound equipment is able to be worn on the user's body, only to enhance portability.

SUMMARY OF THE DISCLOSURE

Accordingly, an object of the present invention is to address the above-noted and other problems and provide a wireless sound equipment which includes speaker modules which face different directions, respectively.

Embodiments of the present disclosure may also provide a wireless sound equipment comprising a body which is wearable on a user's body; a first hole formed in an upper portion of the body; a second hole formed in a lower portion of the body toward the user's body when the user wears the wireless sound equipment; a first speaker configured to output sound via the first hole; and a second speaker configured to output sound via the second hole.

The body may comprise first and second housings located in right and left portions with respect to the user and the first hole, the second hole, the first speaker and the second speaker may be provided in each of the first and second housings.

The body may comprise a band connecting the pair of the housings with each other, and the first housing and the second housing may be provided in right and left sides with respect to the user's neck, when the user wears the body.

When the user wears the body, the first hole may be located more outward in a right-and-left direction with respect to the user's body than the second hole.

When the user wears the body, the first hole may be located more backward than the second hole.

When the user wears the body, the first hole may be located behind the user's ear, and the second hole may be located in front of the user's ear.

Each of the first and second speakers may include a drive unit configured to adjust the location of the speakers located in the body.

When the user wears the body, the second hole is arranged in a position configured to contact with the user's body.

The second hole may be arranged on the user's collar bone.

The body may further comprise a bent portion bent between the first hole and the second hole, and the second speaker may be arranged in a direction which is more similar to a vertical direction than the first speaker is arranged.

The second speaker may be a vibration speaker configured to output sound in a low frequency band to transmit vibration to the user.

The body may include a housing; and a speaker frame located in the housing, the speaker frame of which an angle is variable, and the first hole and the first speaker and/or the second hole and the second speaker may be located.

Embodiments of the present disclosure may also provide a wireless sound equipment comprising a body which is wearable on a user's body; a first hole formed in an upper portion of the body; a second hole formed in a lower portion of the body toward the user's body when the user wears the wireless sound equipment; a first speaker configured to output sound via the first hole; a second speaker configured to output sound via the second hole; and an enclosure accommodating the first speaker and the second speaker and located in the body.

The enclosure may comprise a first accommodating portion for accommodating the first speaker; a second accommodating portion for accommodating the second speaker; a partition wall partitioning off an internal space of the enclosure into the first accommodating portion and the second accommodating portion; and a through-hole formed in the partition wall and allowing the first accommodating portion and the second accommodating portion to communicate with each other.

The through-hole may be arranged in parallel with a line passing a center of the second speaker in the partition wall.

A gradient formed in a bottom surface of the first accommodating portion may be different from a gradient formed in a bottom surface of the second accommodating portion.

The wireless sound equipment may further comprise a boss extended from the enclosure in a direction of the thickness and having a fastening material inserted therein to be fastened to the body, wherein the extension direction of the boss is not perpendicular with the bottom surface of the accommodating portion.

The enclosure may comprise an enclosure housing in which the first speaker and the second speaker are located, and a lower portion of the enclosure housing thinner than an upper portion of the enclosure housing.

The wireless sound equipment may further comprise a speaker seating rib projected from a circumference of the second hole and in contact with a lower surface of the enclosure.

The enclosure may further comprise a rubber sheet attached to an upper surface and a lower surface of the enclosure.

The rubber sheet may comprise one or more cut-away slits.

The body may comprise a pair of housings provided in right and left sides with respect to the user's neck, when the user wears the body; and a band connecting the pair of the housings with each other, and the first hole and the second hole and the first speaker and the second speaker are provided in each of the two housings.

An upper surface of each housing may be inclined outward with respect to the band.

A lower surface of each housing may be inclined inward with respect to the band.

A first lateral surface of each housing which is located toward the user's neck may be thicker than a second lateral surface located outward with respect to the user's body.

The wireless sound equipment may further comprise a shape memory alloy embedded in the band and having ends penetrating the enclosure to be located in the enclosure.

The weight of a center portion and the weights of end portions are symmetrically balanced with respect to the second hole as the center of gravity.

The wireless sound equipment may further comprise a wireless communication unit located in the body and transceiving data by being connected with a host terminal; a sound cable connected with the body; and an earbud coupled to an end of the sound cable and outputting sound, the rotation module and the earbud holder may be overlapped with each other in a wide direction of the body.

The cable hole may be formed in a point, at which the sound cable wound around the rotation module gets loose, in a tangential direction.

The first speaker may be formed in a rectangular or oval shape with a longer axis, and the second speaker may be formed in a circular shape as a vibration speaker configured to output a signal in a low frequency band.

Embodiments of the present disclosure may also provide a wireless sound equipment comprising a body which is wearable on a user's body; a first hole formed in an upper portion of the body; a second hole formed in a lower portion of the body toward the user's body when the user wears the wireless sound equipment; a speaker comprising a first speaker configured to output sound via the first hole and a second speaker configured to output sound via the second hole; a wireless communication unit located in the body and transceiving data by being connected with a host terminal; and a controller controlling the earbud, the first speaker and the second speaker to output the data transmitted by the wireless communication unit based on a state of the sound mode switch.

The wireless sound equipment may further include a sound cable connected with the body; an earbud coupled to an end of the sound cable and outputting sound; a sound mode switch allowing the user to select a first mode implemented to output the data transmitted by the wireless communication unit via the earbud; and a second mode implemented to output the data via the speaker.

The controller may control the output volume level to be lowered to a preset volume level and output, when it is sensed that the current mode of the sound mode switch is converted in case the sound output via the earbud or the speaker is higher than a preset volume level.

The wireless sound equipment may further comprise a volume key configured to adjust a volume output via the earbud or the speaker, wherein the controller adjusts the volume levels of the earbuds and the speaker for a range of volume levels and steps adjustable by the volume button to be different in the first mode from the second mode.

When receiving information about generation of a preset event from the wireless communication unit, the controller may output sound via the speaker, regardless of a state of the sound mode switch.

When receiving information about generation of a preset event from the wireless communication unit, the controller may output sound via the first speaker or the second speaker.

The wireless sound equipment may further comprise a wheel-type volume key for adjusting the volume of the sound output from the speaker. The controller may adjust variation of the volume according to a rotation speed of the volume key.

When the rotation speed of the volume key is high, the size of the volume changeable per unit angle turn may be large. When the rotation speed of the volume key is low, the size of the volume changeable per unit angle turn may be low.

When receiving information about generation of a preset event from the wireless communication unit, the controller may output sound via the first speaker or the second speaker.

The body may comprise first and second housings located in right and left portions with respect to the user, respectively, and in which the first speaker and the second speaker are located, respectively; and a band connecting the pair of the housings with each other. The first hole may be provided behind the second hole, when the user wears the body.

The controller outputs the received data via one of the speakers which is located in a corresponding direction to the direction information, when the data received by the wireless communication unit includes direction information.

A microphone located in the first housing may be further provided. When sound is input to the microphone, the controller may control the speaker located in the second housing to output sound and controls the speaker located in the first housing to be deactivated.

The wireless communication unit may perform wireless communication by A2DP and HFP, and the controller may control the speaker located in the second housing to output designated sound.

The wireless sound equipment may further comprise a mute key for stopping the output of sound. The controller may transmit a signal for stopping the playing music or ending a call to a host terminal, unless the mute mode is released in a preset time period after the mute key is activated.

When ending the call, voice message may be transmitted to the other opposite on the call.

The wireless communication unit may be connected with a host terminal to transmit the data transmitted by the host terminal. The controller controlling the sound output via the speaker of the wireless sound equipment and the sound output via the slave sound equipment to be simultaneously performed by synchronizing.

According to the embodiments of the present disclosure, the wireless sound equipment may provide 3D surround sound by using the speaker modules which face different directions, respectively.

Especially, the vibration speaker which faces the user's body may transmit not only sound but also vibration so as to transmit more vivid sound.

Furthermore, the enclosure in which the speakers are located is capable of expanding the resonance space and then enhancing the sound quality of the speakers.

Still further, the structure configured to locate the second hole of the housing in close contact with the user's body may be realized and the user is able to directly feel the vibration of the second speaker.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein:

FIG. 18 is a diagram to describe a manipulation method of the user input unit provided in one example of the wireless sound equipment;

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
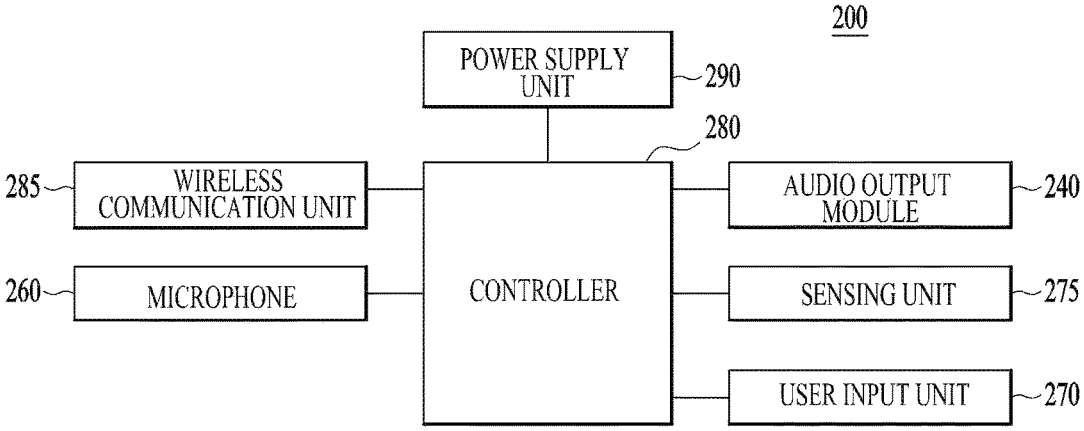
FIG. 1 is a block diagram illustrating a structure of wireless sound equipment in accordance with the present disclosure.

FIG. 1 is a block diagram illustrating a structure of portable sound equipment in accordance with the present disclosure. The portable sound equipment 200 in accordance with the present disclosure includes a controller 280, a wireless communication unit 285, a sound output unit 240, a sensing unit 275, a microphone 260, a user input unit 270 and a power supply unit 290.

The sound output unit 240 is the mechanism configured to output sounds according to a sound signal. An earbud 241 is a device insertedly put on a user's ear to transmit sounds to the user. A speaker 242 is a device spaced apart from the user's ear, not insertedly put on the user's ear, to transmit sounds. Accordingly, the sound output from the speaker is louder than the sound output from the earbud 241.

The earbud 241 is detachable from the main body and insertedly put on the user's ear, which will be described in detail later. The speaker 242 is arranged in the main body. Specifically, the speaker may be arranged in the main body rather than in an elastic band 210, to be right under the user's ear.

The wireless communication unit 285 is implemented to receive data from another portable device such as an external terminal or a base station or transmit the command input via the user input unit to another portable device wirelessly. The wireless communication unit 285 uses short range wireless communication to transceive a signal with the portable device. Examples of such short range wireless communication support the short range communication, using one or more of Bluetooth™, RFID (Radio Frequency Identification), IrDA (Infrared Data Association), UWB (Ultra Wideband), ZigBee, NFC (Near Field Communication), Wi-Fi (Wireless-Fidelity) and Wi-Fi Direct, Wireless USB (Wireless Universal Serial Bus).

When another wireless sound equipment capable of performing short range wireless communication is located in a wireless communicable range, the wireless communication unit 285 is automatically connected with the portable electronic device.

Technical standards or communication methods for mobile communication are used in transceiving signals with base station. For example, the wireless communication unit may transceive a wireless signal with one or more of base station, external terminal and server on a mobile communication network built according to GSM (Global System for Mobile Communication), CDMA (Code Division Multi Access), CDMA2000 (Code Division Multi Access 2000), EV-DO (Enhanced Voice-Data Optimized or Enhanced Voice-Data Only), WCDMA (Wideband CDMA), HSDPA (High Speed Downlink Packet Access) and LTE-A (Long Term Evolution-Advanced).

The wireless signal may include diverse types of data according to a voice call signal, a video telephone call signal or texture/multimedia message transmitting and receiving.

The controller 280 outputs sound by controlling the audio output unit 240 based on the data received from the wireless communication unit, controls a portable electronic device according to the command input via the user input unit or transmits a signal to another portable electronic device connected with the portable electronic device.

The controller 280 may control the wireless communication unit to automatically connect the portable sound equipment with the external terminal sensed by the short range communication unit and be implemented to connect the equipment with the sensed portable electronic device, when determining that the sensed portable electronic device is authenticated.

The microphone 260 processes an external sound signal into electrical voice data. The processed voice data is transmitted to an external terminal or server via the wireless communication unit 285. Various noise removal algorithms can be realized in the microphone 260 to remove the noise generated while the external sound signal is input.

The sensing unit 275 is the device configured to recognize the state and circumstances of the portable sound equipment 200. The sensing unit 275 may include an illuminance sensor for sensing ambient illuminance, a touch sensor for sensing touch input, a gyro sensor for sensing the slope and location of the portable sound equipment 200 and an earbud switch for sensing whether the earbud 241 is located in an earbud holder 225.

The user input unit 270 is the input means configured to allow the user to control the portable sound equipment 200. The user input unit 270 may include a call button 272, a button 273 for sound volume and a power button 271.

Figure 2:
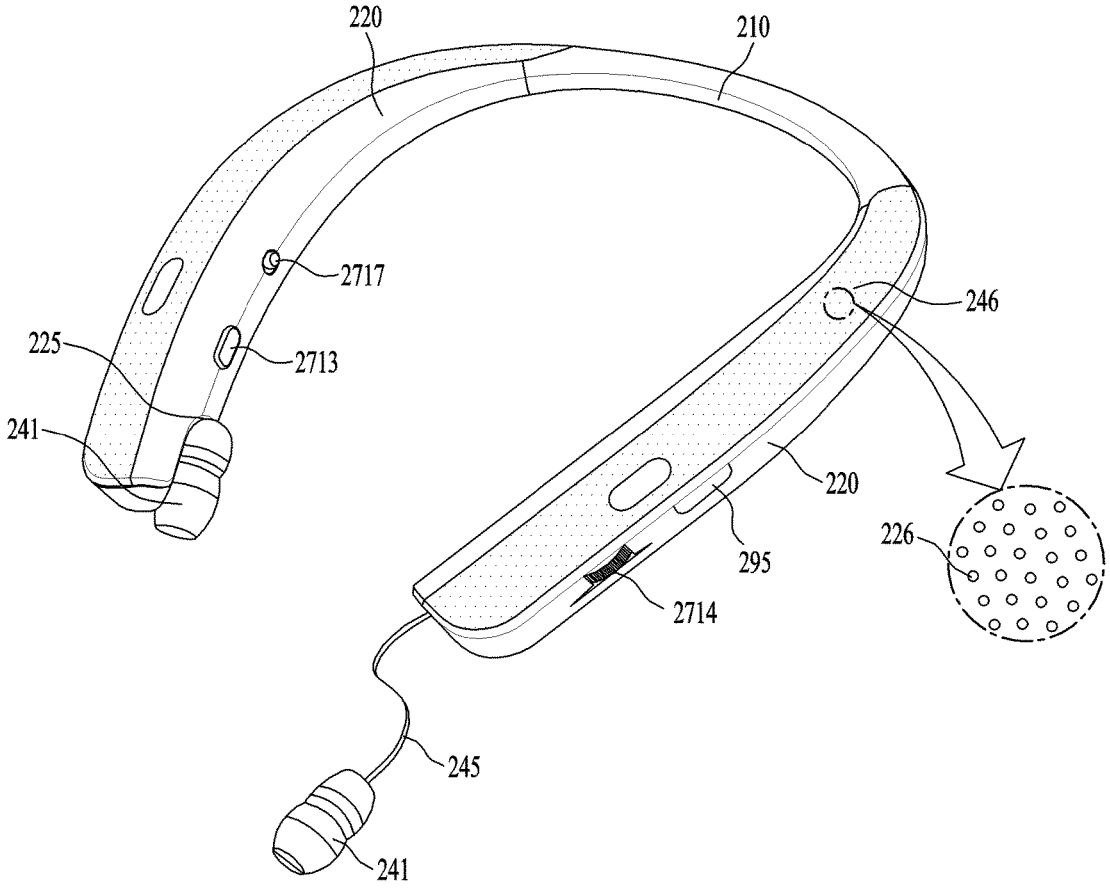
FIG. 2 is a perspective diagram illustrating one example of the wireless sound equipment, viewed in one direction.

FIG. 2 is a perspective diagram illustrating one example of the portable sound equipment 200, viewed in one direction.

The wireless sound equipment 200 has a C-shaped main body and includes a pair of housings 220 arranged in right and left sides and having components mounted therein; and a band 210 connecting the housings 220 with each other. The band 210 has elasticity so that the curvature of the band 210 can change when a user holds and spreads the housings 220. Shape memory alloy (215, see FIG. 14) may be provided in the band 210 and the band 210 is able to restitute even when it is deformed by an external force.

When the user wears the wireless sound equipment 200 on the neck, the band 210 is located on a back of the neck and the pair of the housing 220 located on right and left sides of the neck. The band 210 and the housings 220 may define one consecutive surface. The portion which will contact with the user's neck may be made of a material with a strong frictional force so as to prevent easy separation from the user's body.

A displacement sensor for sensing curvature variation may be provided in the band 210. When the user intends to wear the portable electronic equipment 200, the displacement sensor is capable of sensing whether the user spreads both ends of the wireless electronic equipment 200. In this instance, the curvature of the band 210 is gently changed and it is sensed and determined that the user tries to use the portable electronic equipment 300. After that, the portable electronic equipment 200 may control the power to be switched on or synchronized with an external terminal.

A displacement sensor may sense and consider curvature after sensing the drastic change of the curvature in the band portion 310, so as to determine whether both ends are spread while the user is carrying the portable electronic equipment 300 or when the user intends to wear the portable electronic equipment 200. In case the displacement sensor senses that the curvature is fixed as a second value after the curvature has drastically changed as a first value, it may be determined that the user wears the portable electronic equipment 200 on the neck.

Not only the displacement sensor but also a temperature sensor, an optical sensor or a heat rate sensor may be provided in the surface configured to contact with the user's neck when the user wears the portable electronic equipment 200. When the temperature is in a range of human body temperatures, brightness becomes dark or a heat rate is sensed, it may be determined that the user wears the portable electronic equipment 200. Hence, the portable electronic equipment 300 controls the power to be switched on or the wireless communication unit 285 to become implemented so as to be synchronized with an external terminal.

As one alternative example, a switch which is physically pressable may be provided. When the user wears the portable electronic equipment 200, the switch is pressed and an ON signal is generated. In case the switch-ON state is maintained for a preset time period or more, the power of the portable electronic equipment 200 is switched on or synchronized with an external terminal.

Diverse components may be located in the housing 220 and the housing 220 is made of a material with rigidity. The housing 220 may be formed by injection mold of synthetic resin or of metal. Examples of the metal include steel (STS), aluminum (Al), titanium (Ti) and the like. In the housing 220 are located a main circuit board 281, a battery 291, and a microphone 260. The housing 220 includes a holder provided in an outer surface of the housing and an earbud 241 is coupled to and decoupled from the holder.

The body becomes wider toward the right and left ends from the band 210, extended from an outer back side in a front inner direction. The body has a UFO-like appearance and an upper surface of the body is arranged outward along a shape of the user's shoulder to be closely contact with the user's body. The user's shoulder has a shape formed downward along a right and left direction from the neck and the housing 220 also has a corresponding shape with an upper surface twisted toward right and left outer sides and a lower surface twisted toward the user's neck according to the shape of the shoulder.

The main circuit board 281 has diverse electronic components located thereon such as a controller 280 and is configured to control the electronic components and process the data collected by them (for example, the voice data collected by the microphone 260, the user command sensed from the user input unit 270 and the voice data transmitted from the wireless communication unit 285).

The battery 291 is supplied external power via a charging terminal to be charged and configured to supply the required electric power to each of the electronic components. The battery 291 may be arranged in each of right and left sides for the weight balance or only in one housing, while other components can be arranged in the other housing 220.

The user's voice and other sounds are input to the microphone 260 and the plurality of the microphones 260 may be provided in different portions, respectively, to receive input stereo sound.

An indicator may be further provided to transmit visual information to the user. The indicator may provide the user with different information, using diverse colors and flickering of light. For example, red light is set to flicker during the charging and green light starts to flicker once the charging is complete. In case the wireless communication unit is connected with an external device, blue light is set to flicker.

The earbud 241 has an output module mounted therein and insertedly worn on the user's ear. The earbud 241 may include an ear cap made of a flexible material to get fitted to the user's ear and transmits the sound to the user's ear directly. Because of that, the output of the earbud is lower than that of the speaker. The earbud 241 is detachably coupled to an external earbud holder 225 provided in an outer surface of the housing 220, not located in the main body, and connected to the main board 281 via the audio cable 245 to output the received sound signal.

When the user is carrying in a state of exposing the sound cable 245 outside, the sound cable 245 might get tangled in the user's hair or twisted. To prevent that, a rotation module 250 may be provided to accommodate the sound cable 245. The rotation module 250 is a cylindrical member connected with one end of the sound cable 245. The sound cable 245 is wound around an outer surface of the rotation module 250 and allows the sound cable 245 arranged in the housing 220. The earbud 241 is pulled together with the sound cable only to be seated and coupled to the earbud holder 225.

Figure 3:
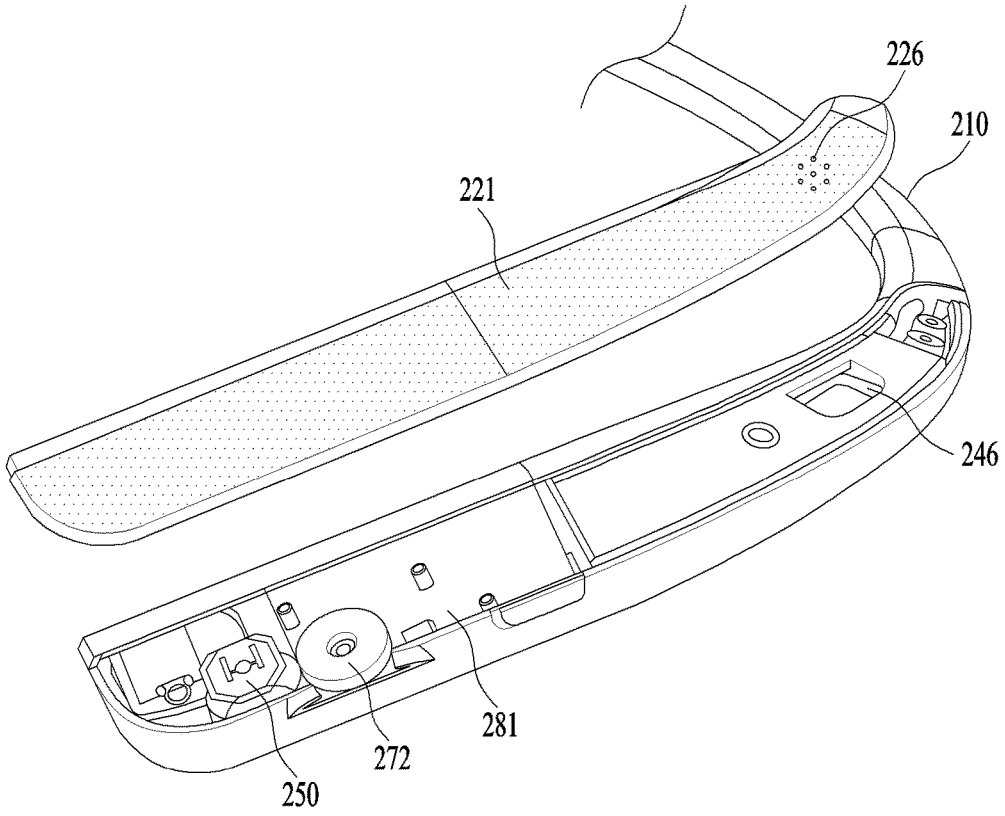
FIG. 3 is a diagram illustrating a state where an upper case provided in one example of the wireless sound equipment.
Figure 4:
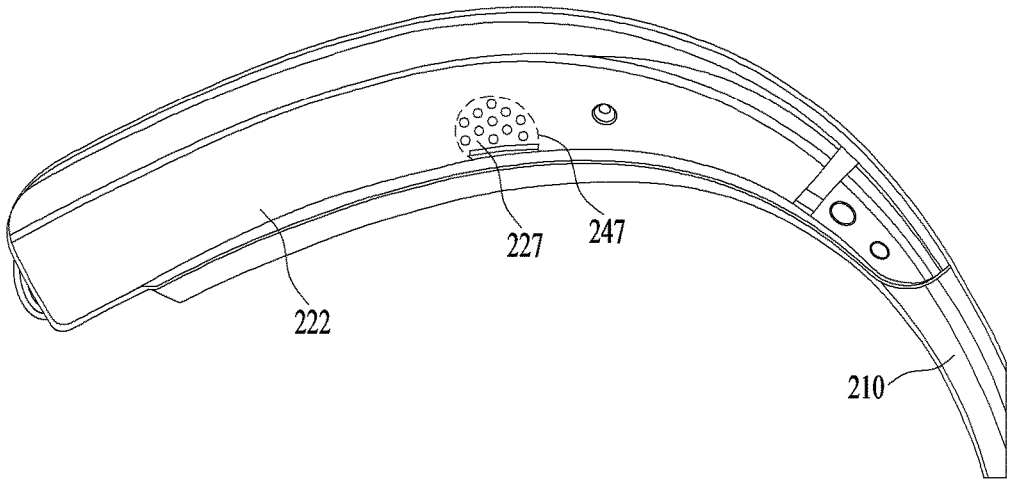
FIG. 4 is a perspective diagram illustrating one example of the wireless sound equipment, viewed in another direction.

FIG. 3 is a diagram illustrating a state where an upper case 221 provided in one example of the wireless sound equipment 200. FIG. 4 is a perspective diagram illustrating one example of the wireless sound equipment 200, viewed in another direction.

In each of the housings 220 may be located a first speaker 246 for outputting voice via a first hole 226 formed in an upper surface and a second speaker 247 for outputting sound via a second hole 227 formed in a lower surface.

The first speaker 246 and the second speaker 247 may be arranged toward a different direction. The first speaker 246 is arranged toward an upper surface of the housing to output sound toward the user's ear and the second speaker 247 is arranged toward a lower surface of the housing to output sound toward the user's body. The first speaker 246 and the second speaker 247 may be located in the housing 220 as one module or located in the housing 220 as independent modules, respectively.

The first speaker 246 may be a full range speaker 246 configured to output sound in all frequency bands uniformly and the second speaker 247 may be a vibration speaker configured to output sound in middle and low frequency bands.

Sound in a high frequency band has a short wavelength and tends to go straight. When meets an obstacle, the high frequency band sound is reflected, not transmitted. Accordingly, directivity is important in transmitting the high frequency sound and a different sound effect is obtained according to the directivity.

Sound in a low frequency band has a long wavelength and diffracts easily to be transmitted, even when a direction of low frequency sound is toward the user's ear. Especially, the second hole 227 in which the second speaker 247 of the present disclosure is located may be provided in the lower surface of the housing 220 so as to allow sound to directly contact with the user's body to directly transmit sound to the user's body. The low frequency sound has an effect of vibration and is capable of obtaining the vibration effect, even without a vibrating element.

Figure 5:
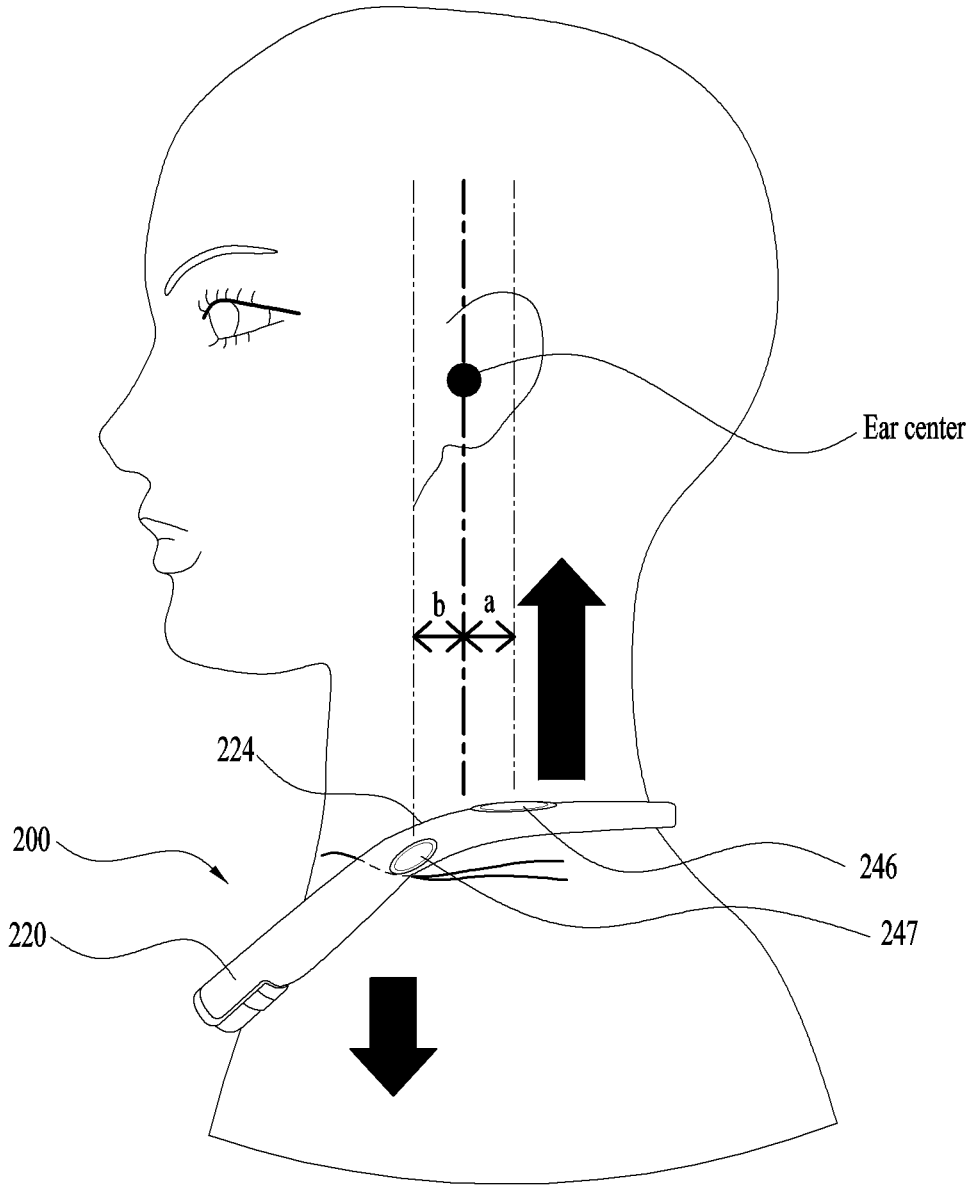
FIG. 5 is a perspective diagram illustrating a state where a user wears one example of the wireless sound equipment.
Figure 6:
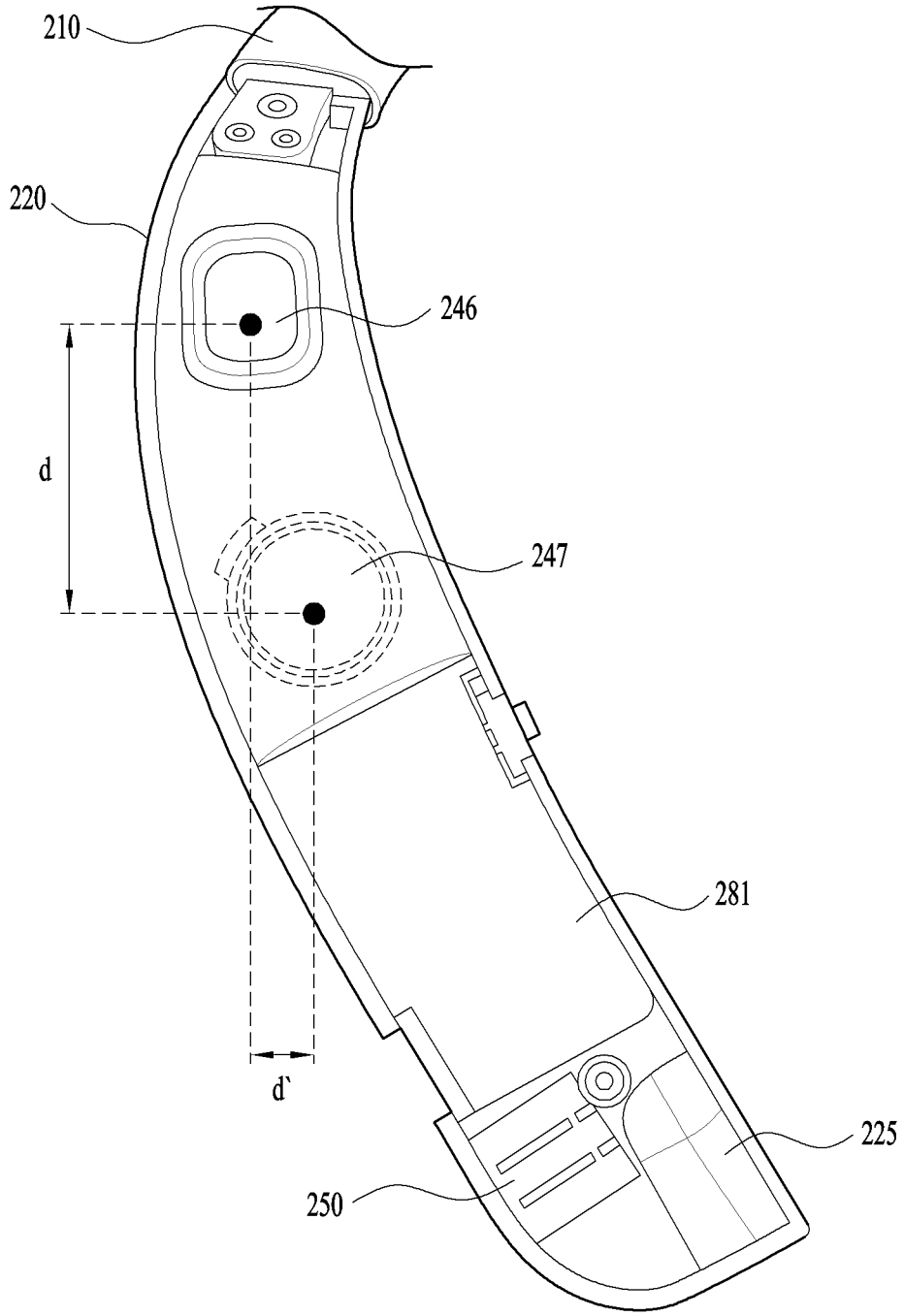
FIG. 6 is a diagram illustrating a location relation among speakers provided in one example of the wireless sound equipment.

FIG. 5 is a perspective diagram illustrating a state where a user wears one example of the wireless sound equipment 200. FIG. 6 is a diagram illustrating a location relation among speakers 246 and 247 provided in one example of the wireless sound equipment 200.

Referring to FIGS. 5 and 6, the first speaker 246 and the second speaker 247 may be provided in each of the right and left housings 220. The four speakers 246 and 247 may be provided. Even though additionally more speakers 246 and 247 may be provided, sounds with diverse directivities can be provided by only using the four speakers 246 and 247.

As shown in FIG. 5, the first speaker 246 may be located behind the user's ear, distant as far as 'a' and the second speaker 247 is located in front of the user's ear, distant as far as 'b', when the user is wearing the wireless sound equipment 200. As shown in FIG. 6, the first speaker 246 may be located in an outer region in a right-and-left direction and the second speaker 247 in an inner region in the right-and-left direction, with respect to the state where the user is wearing the wireless sound equipment 200.

More specifically, the first speaker 246 and the second speaker 247 are spaced a distance of 'd' apart from each other in a back-and-forth direction and a distance of 'd'' in a right-and-left direction, with respect to the state where the user is wearing the wireless sound equipment 200. The back-and-forth direction distance (d) between the first speaker 246 and the second speaker 247 may be calculated from the size of the user's ear. Statistically, the size of the ear is 28.4 mm~31.8 mm so that the back-and-forth direction distance (d) between the first speaker 246 and the second speaker 247 may be spaced 27 mm~40 mm apart from each other, corresponding to the size of the user's ear.

If the distance between the first and second speakers becomes wider, more energy will be needed. Accordingly, the first and second speakers are arranged distant not too far from the user's ear. If the distance between them becomes narrow, it is difficult to realize 3D dynamic sound so that the distance between the first and second speakers may be adjusted to arrange them according to the user's size.

The body of the wireless sound equipment 200 in accordance with the present disclosure has the C-curved shape and becomes wider rightward and leftward from the connected portion with the band 210 and the housings 220 to become narrower toward the ends of the housings 220.

The first speaker 246 is located a little behind the user's ear in a lower portion which is vertically distant from the user's ear. The second speaker 247 is located a little in front of the user's ear and at the user's collar bone, so that the second speaker 247 may be arranged more inside than the first speaker 246 in the right-and-left direction.

The first speaker 246 is located behind the user's ear and the sound output from the first speaker 246 is transmitted via the earflap, different from the sound transmitted the speaker located in front of the user or the sound directly transmitted to the earhole via the speaker inserted in the ear. Accordingly, the sound output from the first speaker 246 causes time difference to be heard like the sound reflected in a closed space or the sound heard behind the user.

As shown in FIG. 5, the shoulder located right and left sides of the neck is upward and the chest is forward in the user's body so that the collar bone is located obliquely upward from a forward direction. Accordingly, the first hole 226 is formed upward to output sound upward and the second hole 227 is directly in contact with the user's collar bone to output sound toward the collar bone, so that a direction which the first hole faces may be different from a direction in which the second hole 247 is formed.

To make the direction of the first speaker 246 be different from that of the second direction, the housing 220 may further include a bent portion 224 which is bent downward, in other words, prominent upward between the first speaker 246 and the second speaker 247. When the user is wearing the wireless sound equipment 200 on the neck, a rear portion is located upward and a front portion with respect to the bent portion 224 obliquely upward.

More channels (for example, 5.1 channel and 7.1 channel) than the four speakers 246 and 247 may be realized by using the speakers located in the housings 220. A conventional 5.1 channel home theater system has five speaker which are arranged in a left front portion, a right front portion, a front portion, a left rear portion and a right rear portion; and a woofer speaker is additionally arranged to facilitate dynamic 3D sound appreciation.

The first speakers 246 and the second speakers 247 are dividedly arranged right and left with respect to the user's ear, distant not so far from each other, only to function as left front, right front, left rear and right rear speakers 246 and 247. When both of them start to output sound simultaneously, the two second speakers 247 may obtain a similar effect to the effect of the front speaker. The second speakers are vibration speakers and capable of functioning as the woofer speaker.

A sweet spot which is a point allowing the user to listen to optimized sound may be preset in the conventional home theater. If getting out of the sweet spot, the user cannot appreciate music properly disadvantageously. Since the sound output from the speakers of the home theater system sounds nearby, it is necessary to install the soundproof facility for music appreciation.

However, the wireless sound equipment 200 is wearable on the user's body and the speakers 246 and 247 are fixedly arranged, spaced apart from the user's ear. Accordingly, the wireless sound equipment 200 has no locational limitation. As the distance to the user's ears from the speakers is narrower than the distance to the user from the speakers of the home theater system, even low output sound allows the user to appreciate music with sense of realism and the wireless sound equipment of the present disclosure allows the user to appreciate music even without the soundproof facility.

Especially, as directly transmitting sound to the user's body, the second speakers 247 allows the user to be capable of appreciating music more vividly and the user is able to use the second speakers 247 more effectively when listening to media contents such as a game or virtual reality (VR).

When receiving a sound signal by Bluetooth to realize 5.1 channel sounds, the sound signal is converted into 2 channel signal and the sound data actually divided as 5.1 channel might damage disadvantageously. The controller 280 is implemented to decode the 2 channel signal transmitted by Bluetooth and supply sound to the four speakers 246 and 247 dividedly.

Even unless decoding the 2 channel signal, the four speakers 246 and 247 are arranged in the front, rear, left and right portions and have directivities with respect to the user's ears, respectively. Accordingly, the user may be provided with a surround sound effect.

Figure 7:
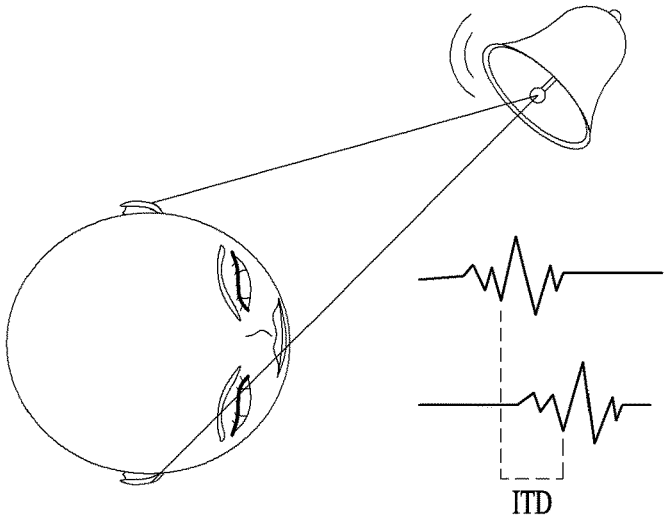
FIG. 7 is a diagram to describe a head related transfer function which is applied to one example of the wireless sound equipment.
Figure 7:
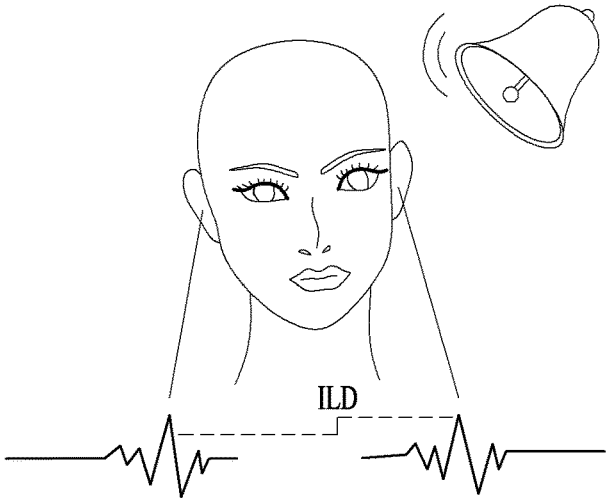

FIG. 7 is a diagram to describe head-related transfer functions which are applied to one example of the wireless sound equipment.

As the user's ears are located in right and left sides of the head, there is a time difference between the sound heard in the left side and the sound heard in the right side and the user hears the louder sound in the closer ear.

As shown in FIG. 7 (*a*), the time difference between the sound heard from the left ear and the sound heard from the right ear may be referenced to as ITD (Interaural Time Difference) and the level difference between the sound from the left ear and the sound from the right ear may be referenced to as ILD (Interaural Level Difference).

The sound actually sensed in the left ear is different from the sound actually sensed in the right ear with respect the same sound source, as the face becomes an obstacle on sound deliver passage as well as simple distance difference. The functions for accurately calculating such the differences are HRTF (Head Related Transfer Functions).

Head Related Transfer Function means a function for calculating an impulse reply of left and right sides with respect to points between 360 degree azimuth and 180 degree altitude at preset intervals, using a dummy head microphone which is modeled from the human auditory organ, to formulate that a listener is able to sense a surround sound based on a phenomenon that characteristics on a sound passage such as diffraction on the head surface and reflection caused by the earflap curve are changed according to an arrival direction of sound.

The user as the listener is able to sense sound dynamically according to not only a sound delay level of the sounds sensed in the left ear and the right ear but also a volume and reverberation (echo) so as to feel a sense of distance of the sound source.

Figure 8:
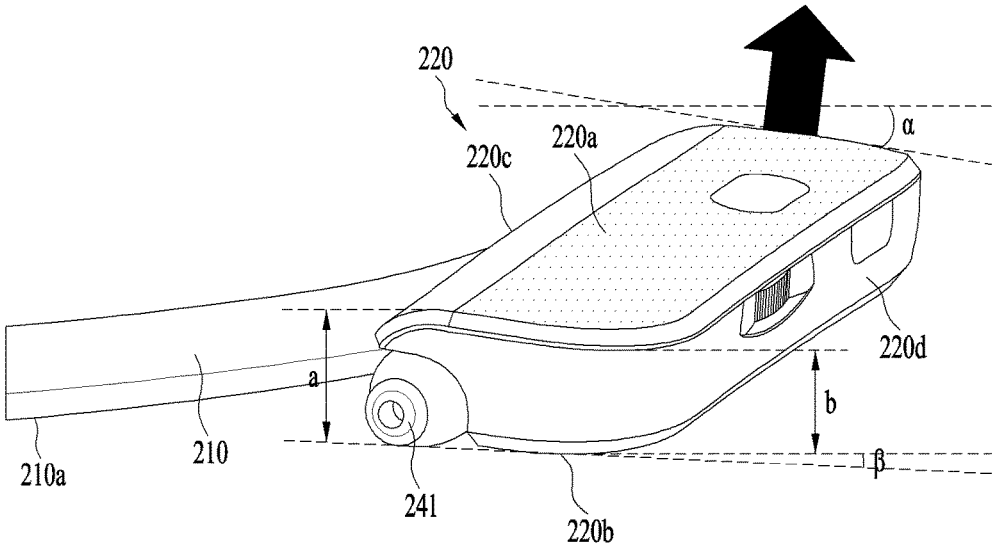
FIG. 8 is a diagram to describe a gradient of a housing in accordance with one embodiment.

FIG. 8 is a diagram to describe the shape of the housing 220 provided in one example of the wireless sound equipment 200. The first hole 226 for injecting the sound output from the first speaker 246 is formed toward the user's neck, the sound might fails to be transmitted to the user. Because of that, the housing 220 may be formed outward for the upper surface 220*a* to be inclined as far as a from a horizontal surface. The horizontal surface means the horizontal surface with respect to a portion in contact with the ground, when the wireless sound equipment 200 of the present disclosure is put on the ground or floor with respect to a center 210*a* of the band 210.

The lower surface 220*b* of the housing 220 may be also inclined as far as β. The lower surface 220*b* of the housing is arranged toward the user to closely contact with the user' body. The user's shoulder is inclined downward from the neck toward the arms and the housings 220 are located on a connected body part between the neck and the shoulder. Accordingly, the lower surfaces 220*b* of the housings 220 are inclined corresponding to the shape of the body to closely contact with the user's body.

When α is larger than β, in other words, a gradient of the upper surface 220*a* is larger than a gradient of the lower surface 220*b*, an inner lateral surface 220*c* toward the user's body becomes thicker than an outer lateral surface 220*d* located in the reverse direction (a>b). If the outer lateral surface 220*d* is thicker, the volume of the housing looks larger. Accordingly, the gradient of the upper surface 220*a* may be larger than that of the lower surface 220*b* to make the outer lateral surface 220*d* thicker than the inner lateral surface 220*c*.

Figure 9:
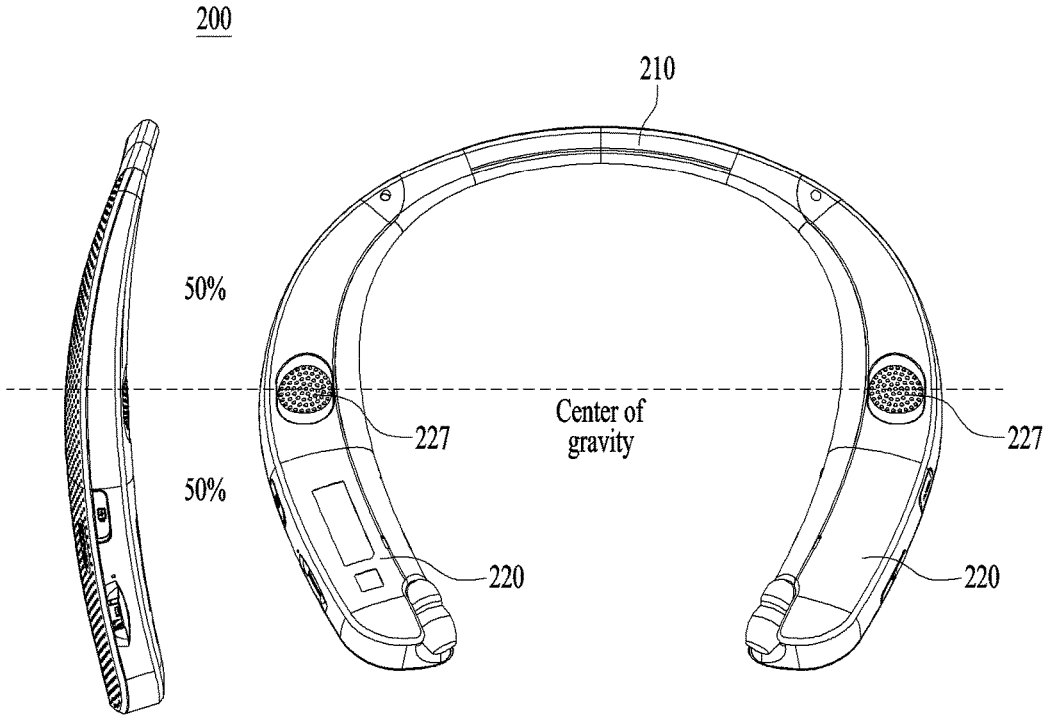
FIG. 9 is a perspective diagram illustrating to describe a weight of gravity in the wireless sound equipment.

FIG. 9 is a perspective diagram illustrating to describe a weight of gravity in the wireless sound equipment 200. The ends of the housing 200 and the band 210 are designed in symmetry at the second hole 227 as the center of gravity in the wireless sound equipment 200. The main circuit board 281, the battery 291 and the rotation module 250 are located in the housing toward the end of the housing and the first speakers 246 and the band 210 are arranged in the housing toward the band 210 with respect to the second hole 227, only to balance the weights of both sides (50%:50%).

As it is the center of gravity in the wireless sound equipment 200, the second hole 227 can be closely in contact with the user's body and the vibration of the second speaker output via the second hole 227 may be directly transmitted to the user's body.

Figure 10A:
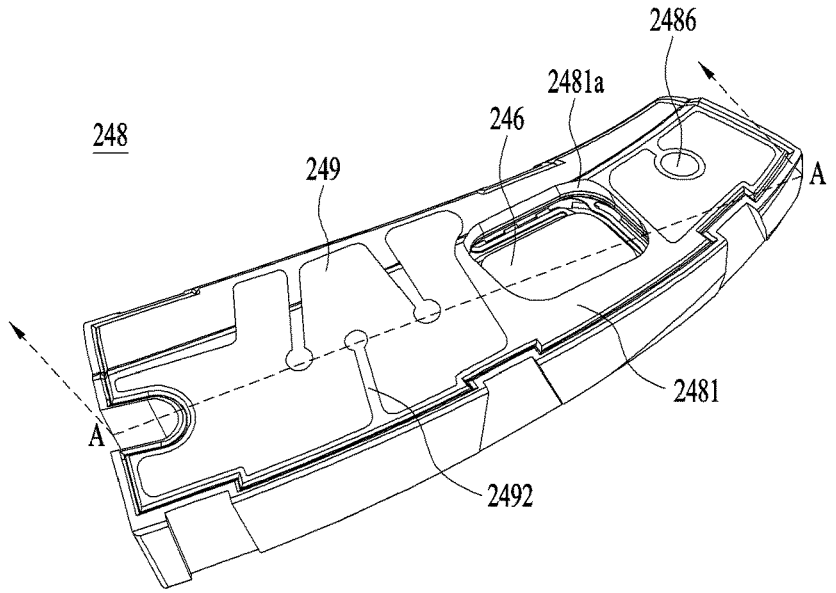
FIGS. 10A and 10B are a perspective diagram illustrating one surface and the other surface of an enclosure in which speakers of the wireless sound equipment are located.
Figure 10B:
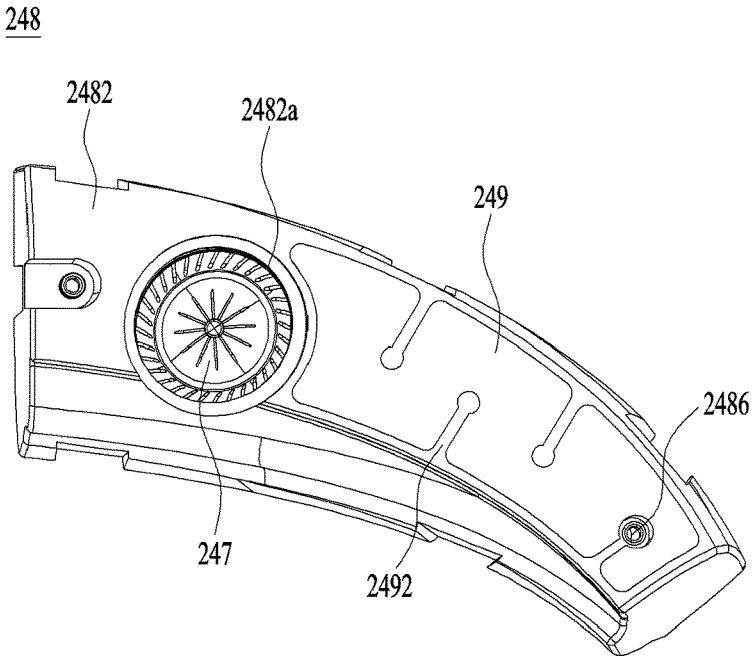

FIGS. 10A and 10B are perspective diagrams illustrating one surface and the other surface of an enclosure 248 in which the speakers 246 and 247 are located. The first speaker 246 and the second speaker 247 are located in one enclosure 248 to be coupled in the housing 220.

The enclosure 248 defines a resonance space of the first and second speakers 246 and 247. The sound output from the speakers 246 and 247 is amplified into louder and richer sound while reflected in a closed resonance space with a certain size corresponding to the capacity of the speakers. Accordingly, the resonance space is important in determining the capacity of the speakers 246 and 247.

In this instance, it is difficult to secure a sufficient resonance space in a conventional mobile terminal because of its limited small size. An internal empty space of the housing 220 is closed airtight to be used as the resonance space or blocked by a member such as a tape to realize the resonance space. The wireless sound equipment 200 in accordance with the present disclosure may use the enclosure 248 configured as an auxiliary resonance so as to provide a high-quality sound.

All of the first and second speakers 246 and 247 may be located in the enclosure 248 of the present disclosure. As the first speaker 246 is formed upward and the second speaker 247 is formed downward, a hole 2481*a* for exposing the output point of the first speaker 246 is formed in the enclosure, corresponding to the first hole 226, and another hole 2482*a* for exposing the output point of the second speaker 247 is formed in the enclosure, corresponding to the second hole 227.

The second speaker 247 provided as the vibration speaker is thicker than the first speaker 246, the portion of the enclosure 248 where the second speaker 247 is located may be formed thicker. The first speaker 246 may be a longitudinal or oval shaped speaker and the second speaker 247 may a circular speaker. In this instance, a cross section of the first speaker 246 may be arranged in a width direction of the housing 220 to narrow the width of the housing in which the first speaker 246 is located.

It is preferred that the first speaker 246 is a full range speaker having a long side and a short side to output sound in diverse ranges. In other words, the long side is optimized for sound in a middle range and the short side is optimized for sound in a high range.

Meanwhile, the second speaker 247 is a circular speaker as the vibration speaker for outputting sound in a low frequency band, which is the most efficient in transmitting energy to output the low frequency sound with becoming non-directive and size concentrated.

The housing 220 of the present disclosure shown in FIG. 2 forms a consecutive surface with the band 210. The housing 220 becomes narrower as getting closer to the band 210 and wider than the connected portion as getting closer to the ends. The enclosure 248 is arranged in the housing 220, adjacent to the band 210, so that the portion having the first speaker 246 located therein may be narrower than the portion having the second speaker 246 located therein, along the gradually wider shape from the band 210 to the housing 220.

Figure 11:
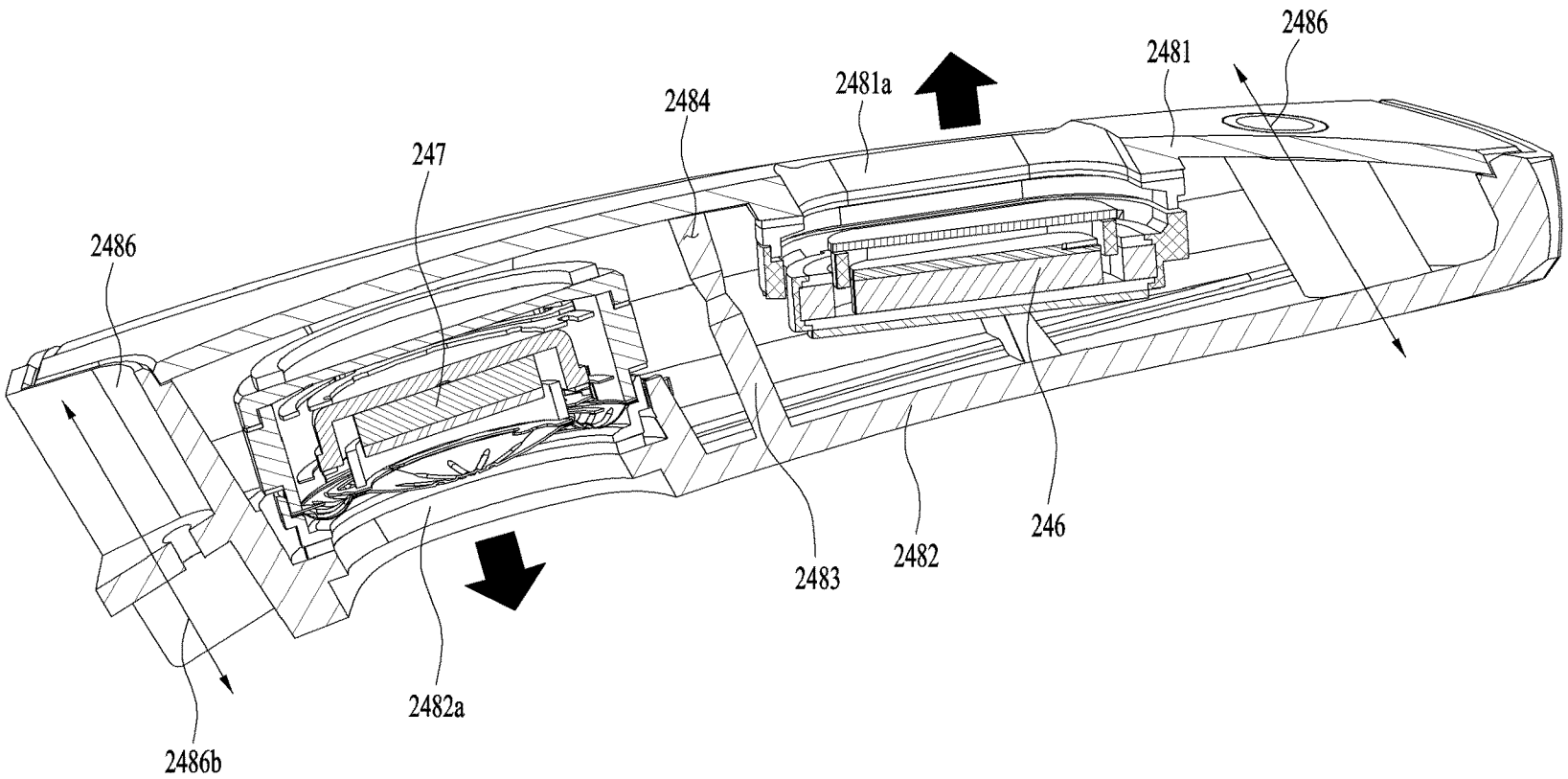
FIG. 11 is a sectional diagram illustrating the enclosure of FIG. 10A.
Figure 12:
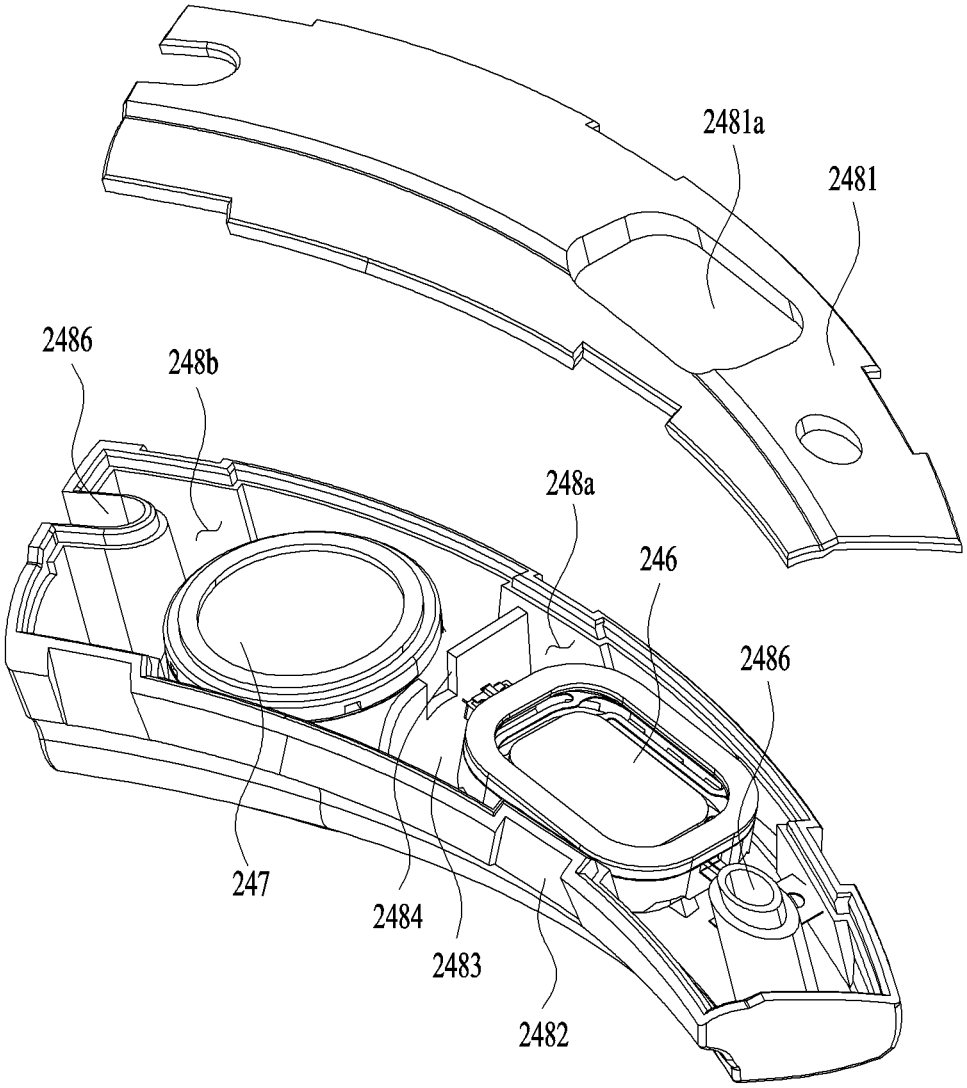
FIG. 12 is a perspective diagram of an upper case which is cut away from the enclosure of FIG. 10A.

FIG. 11 is a sectional diagram along A-A line of FIG. 10A. FIG. 12 is a perspective diagram of an upper case which is cut away from the enclosure 248 of FIG. 10A.

The enclosure 248 of the present disclosure includes a first accommodating portion 248*a* for accommodating the first speaker 246 and the second speaker 247; and a second accommodating portion 248*b* for accommodating the second speaker 247.

The first accommodating portion 248*a* and the second accommodating portion 248*b* are partitioned off from each other by a partition wall 2483. A through hole 2484 is formed in the partition wall 2483 to allow communication between the first accommodating portion 248*a* and the second accommodating portion 248*b*. The first accommodating portion 248*a* and the second accommodating portion 248*b* may function as resonance spaces, respectively. A predetermined space with a size of 30 cc or more has to be provided in the first and second accommodating portions 248*a* and 248*b* to secure sufficient resonance spaces for two speakers 246 and 247. However, in this instance, there might be a disadvantage of too large-sized wireless sound equipment 200.

To solve the disadvantage of the present disclosure, the through-hole is formed in the partition wall 2483 for partitioning off the internal space of the enclosure into the first accommodating portion 248*a* and the second accommodating portion 248*b*, so that the resonance space with the size of the united first and second accommodating portions 248*a* and 248*b* may be realized. If the first and second speakers 246 and 247 output sound in the same direction, the flow of air vibrated by the first speaker and the flow of air vibrated by the second speaker 247 might interfere with each other enough to deteriorate the sound quality.

However, the first speaker 246 and the second speaker 247 output sound in different directions as shown in FIG. 10A, the first accommodating portion 248*a* and the second accommodating portion 248*b* may be open by minimizing the interference.

More specifically, the sound output from the first speaker 246 uses both the first accommodating portion 248*a* and the second accommodating portion 248*b* as the resonance space. The sound output from the second speaker 247 may also use both of them as the resonance space. Accordingly, the size of the enclosure 248 can become smaller, compared with the enclosure configured of the first accommodating portion 248*a* and the second accommodating portion 248*b* which are separated.

Without the partition wall 2483, the entire space becomes too broad to counter the resonance effect. If the air flow vibrated by the first speaker 246 directly meets the air flow vibrated by the second speaker 247, an eddy might be generated unintendedly. The first accommodating portion 248*a* and the second accommodating portion 248*b* may be realized in the enclosure 248 with the partition wall 2483 having the through-hole, not omitting the partition wall completely.

As the second speaker 247 as the vibration speaker outputs sound in the low frequency band, the amplification enabled by the resonance is very important and the through-hole 2484 is formed in the partition wall, corresponding to a center of the second speaker. Accordingly, the enclosure may be designed to be more proper to the resonance of the second speaker 247.

An upper enclosure housing 2481 is coupled to a lower enclosure housing 2482, only to realize the closed resonance space of the enclosure. A hole 2481*a* is formed in the upper enclosure housing 2481 in an output direction of the first speaker 246. A hole is formed in the lower enclosure housing is formed in the lower enclosure housing 2482 in an output direction of the second speaker 247.

As shown in FIG. 11, the directions of the sound output from the first speaker 246 and the second speaker 247 are not completely opposite to each other. When the user is wearing the body of the wireless sound equipment, the first speaker 246 outputs sound upward and the second speaker 247 outputs sound toward the user's collar bone. A bottom surface of the first accommodating portion 248*a* on which the first speaker 246 is seated is not in parallel with a bottom surface of the second accommodating portion 248*b* on which the second speaker 248 is seated, so as to guide the directions of the sound output from the first speaker 246 and the second speaker 247.

The enclosure 248 includes a boss 2486 for inserting a screw therein to be coupled to the housing 220. The boss 2486 shown in FIG. 11 is extended in a direction along the thickness of the enclosure 248. When the boss 2486 is extended in the direction which is parallel with the direction in which sound is output by the vibration of vibration plates provided in the first speaker 246 and the second speaker 247, the screw may be movable within the boss 2486 according to the vibration so as to weaken the coupling between the enclosure 248 and the housing 220. Especially, the second speaker 247 as the vibration speaker generates large vibration and the second speaker 247 might affect the coupling between the enclosure 248 and the housing 220.

To prevent the screw from becoming loose in the boss 2486, the boss 2486 of the present disclosure may be formed obliquely, not parallel with the vibration direction of the vibration plate or the output direction of sound in the second speaker 247. It is preferred that the boss 2486 is formed not even in parallel with the vibration direction of the vibration plate provided in the first speaker 246. Also, the area in which the screw is fastened to the boss 2486 is increased by in forming the boss 2486 obliquely and the fastening force can be then enhanced.

The second speaker 247 provided as the woofer speaker is the most efficiency when vibration concentrated on a specific point, not spread broadly, has to be transmitted to the user for the user to directly feel the vibration. To prevent the vibration of the second speaker 247 from being spread, a rubber sheet 249 is attached to the upper and lower surfaces of the enclosure 248. The rubber sheet 249 is disposed between the enclosure 248 and the housing 220 and made of a material with elasticity.

In addition, a cut-away slit 2492 may be partially formed in the rubber sheet 249 to block the vibration transmitted to the housing 220 via the rubber sheet 249. The vibration transmitted along the rubber sheet 249 is blocked by the cut-away slit 2492 and the vibration of the second speaker 247 may not be spread broadly to be directly transmitted to the user via the second hole 227. An end of the cut-away slit 2492 shown in FIGS. 10A and 10B may be formed circular to prevent tearing of cut-away slit.

Figure 13:
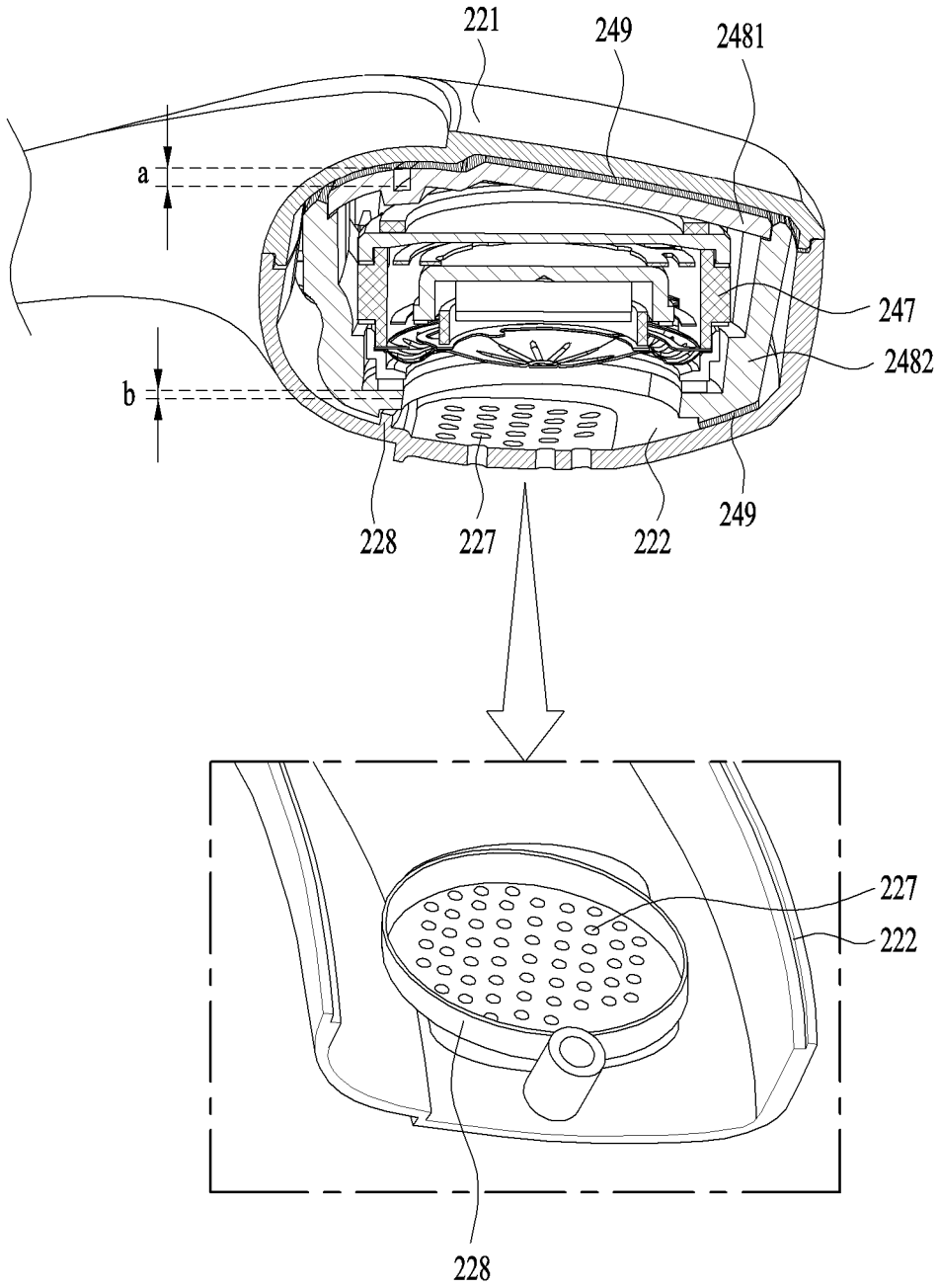
FIG. 13 is a sectional diagram of a second speaker provided in one example of the wireless sound equipment.

FIG. 13 is a sectional diagram of the second speaker 247 provided in one example of the wireless sound equipment 200. A speaker seating rib 228 is projected from an inner circumference of the second hole 227 and the enclosure 248 may be in contact with the speaker seating rib 228, to transmit the vibration of the second speaker 247 directly to the user's body. The vibration is prevented from escaping via the housing 220 by minimizing the area directly in contact with the case, except the speaker seating rib 228. The second hole 227 is the portion configured to directly contact with the user's body and the vibration is directly transmitted to the user's body via the speaker seating rib 228.

The wireless sound equipment 200 of the present disclosure may include the rubber sheet 249 and the speaker seating rib 228 to make the vibration not spread but concentrated on the second hole 227 directly contacting with the user's body and to directly transmit the vibration of the second speaker 247 to the user's body. The housing 220 has a curved shape and the lower surface of the housing 220 is inclined so that the second hole 227 may closely contact with the user's body.

Figure 14:
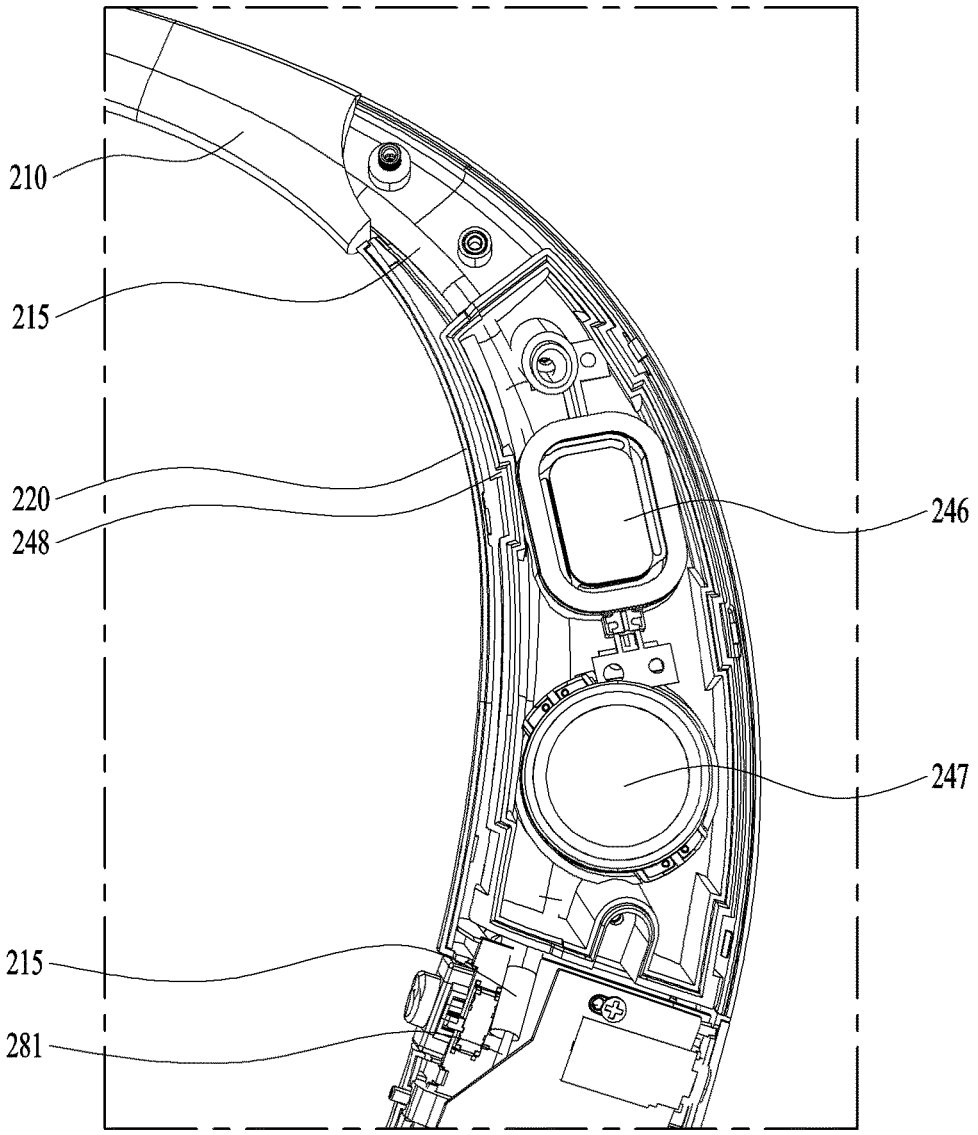
FIG. 14 is a diagram illustrating an inside of a connected portion between a band and a housing.

FIG. 14 is a diagram illustrating an internal space of the connecting portion between the band 210 and the housing 220. A shape memory alloy 215 may be inserted in the band 210 of the present disclosure to inforce the elasticity for restituting the band 210 to an original shape. The shape memory alloy 215 is the material with a restoring force for restoring the deformed shape into an original shape. In the conventional wireless sound equipment, the shape memory alloy is located only in the band 210 or partially in the housing 220. However, the wireless sound equipment 200 of the present disclosure includes the speakers 246 and 247 and miscellaneous vibration is generated by the speakers 246 and 247. To prevent the miscellaneous vibration from giving an unpleasant feeling to the user, the shape memory alloy 215 may be extended to the enclosure 248.

More specifically, the shape memory alloy 215 of the wireless sound equipment 200 is extended from the band 210 and both ends of the shape memory alloy penetrate the enclosure 248 as shown in FIG. 14, only to disperse the miscellaneous vibration.

The band 210 may further include a signal line electrically connecting both housings 220 with each other as well as the shape memory alloy 215. The signal line and the shape memory alloy 215 are inserted in a tube to tie them together. The signal line has to be extended to a main circuit board located in the housing 220 so that the tube having the shape memory alloy 215 and the signal line inserted therein may penetrate the enclosure 248 to be extended to the main circuit board located in the end of the housing 220.

Figure 15:
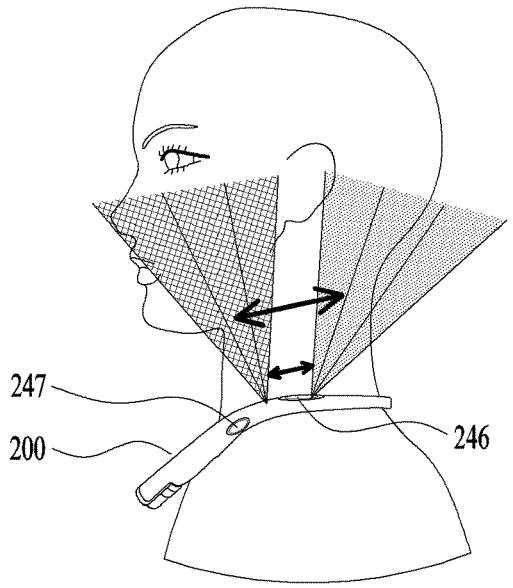
FIG. 15 is a diagram to describe the output of sound according to variation of speaker location in one example of the wireless sound equipment.
Figure 15:
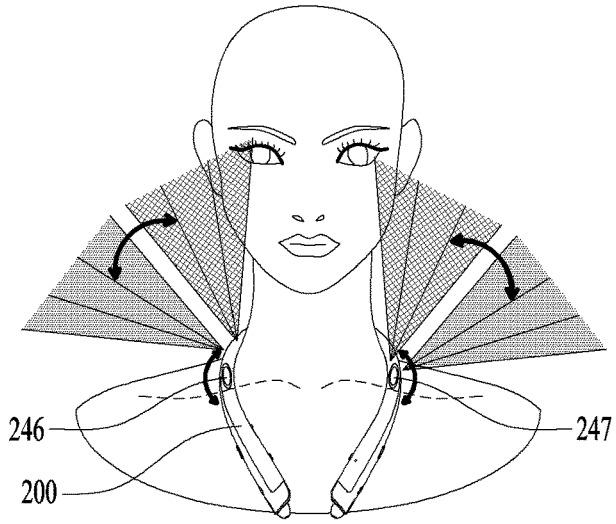

FIG. 15 is a diagram to describe the output of the sound according to change of the locations of the speakers 246 and 247 provided in the wireless sound equipment 200. As mentioned above, the first speaker 246 and the second speaker 247 located in the enclosure 248 is fixed in the housing 220.

However, every user has a different body size and the wireless sound equipment is then manufactured based on Korean standard body size. in case of a user having a significantly different body size, the ears happen not to fit into the speakers of the wireless sound equipment.

To compensate the defect, a speaker frame may be provided for the speakers 246 and 247 and the holes 226 and 227 of the present disclosure. The location of the speaker frame is variable with respect to the housing 220 so that the speakers 246 and 247 can be arranged in optimized locations for each user.

For that, the speaker frame is variable with respect to the housing 220 in location or size. The first speaker 246 and the first hole 226 or the second speaker 247 and the second hole 227 may be formed in the speaker frame. When the speaker frame is moved, the first speaker 246 and the first hole 226 or the second speaker 247 or the second hole 227 located in the speaker frame may be moved together.

As shown in FIG. 15 (*a*), the first speaker 246 is moved in a longitudinal direction of the housing 220 to be moved forward and backward when the user wears the wireless sound equipment 200. As every user has a little different neck size and a different ear location, the user is able to locate the first speaker 246 slightly to the back from the ear.

As shown in FIG. 15 (*b*), the direction can be adjusted by rotating the first speaker 246. When the user's head is large, the ears are located outside in comparison with an average location. When the user's head is small, the ears are located inside in comparison with the average location. Considering the difference of the user's head size, the direction which the first speaker faces may be adjusted.

The drawing shows only the first speaker 246 and the second speaker 247 is also variable in location or direction so that the second speaker 247 may be adjusted to be appropriately located on the user's collar bone.

Figure 16:
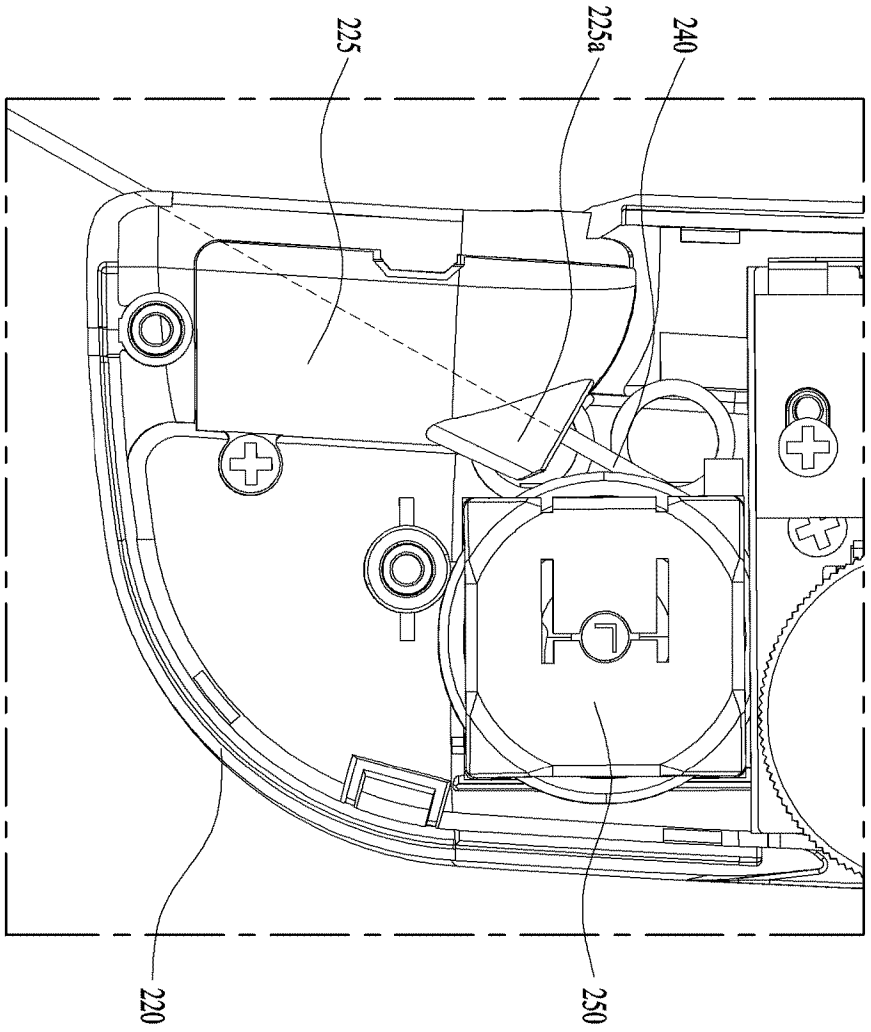
FIG. 16 is a diagram illustrating an earbud coupling portion and a rotation module in accordance with one embodiment.

FIG. 16 is a diagram illustrating the earbud holder 225 and the rotation module 250 in accordance with one embodiment. The housing 220 of the wireless sound equipment 200 become large and wide because of the speakers 246 and 247 located therein. Accordingly, the earbud holder 225 may be biased in the end of the housing 220.

When arranged in an outer surface of the housing 220, the earbud holder 225 might be exposed outside and contaminated so that it can be difficult to realize the neat exterior. The earbud holder 225 may be arranged in an inner surface of the housing 220.

A conventional rotation module 250 and an earbud holder 225 may be arranged side by side along a longitudinal direction of the housing 220. However, the wireless sound equipment 200 includes the two speakers 246 and 247 in one housing 220 and it might have a disadvantage of a longitudinally large size. To prevent the wireless sound equipment 200 from becoming longitudinally too large, the rotation module 250 of the wireless sound equipment 200 may be overlapped with the earbud holder 225 and the housing 220 along the width of the earbud holder 225 and the housing 220 as shown in FIG. 16.

A cable hole 225*a* in communication with the inside of the housing 220 is formed in the earbud holder 225. A sound cable 245 connecting the earbud 241 and the main board with each other may penetrate the cable whole 225*a*. The sound cable 245 is wound around the rotation module 250 to be kept in the housing 220. When the earbud holder 225 and the rotation module 250 are arranged obliquely as shown in FIG. 16, the sound cable 245 wound around the rotation module 250 might be bent in penetrating the cable hole 225*a*.

The bent sound cable 245 might wear out when leading in and out from the housing 220. Accordingly, the cable hole 225*a* may be formed in a tangential direction of the rotation module 250 as shown in FIG. 16. In other words, the cable hole 225*a* is formed in the tangential direction of the rotation module 250 for the sound cable 245 to penetrate without getting loose and bent.

Figure 17:
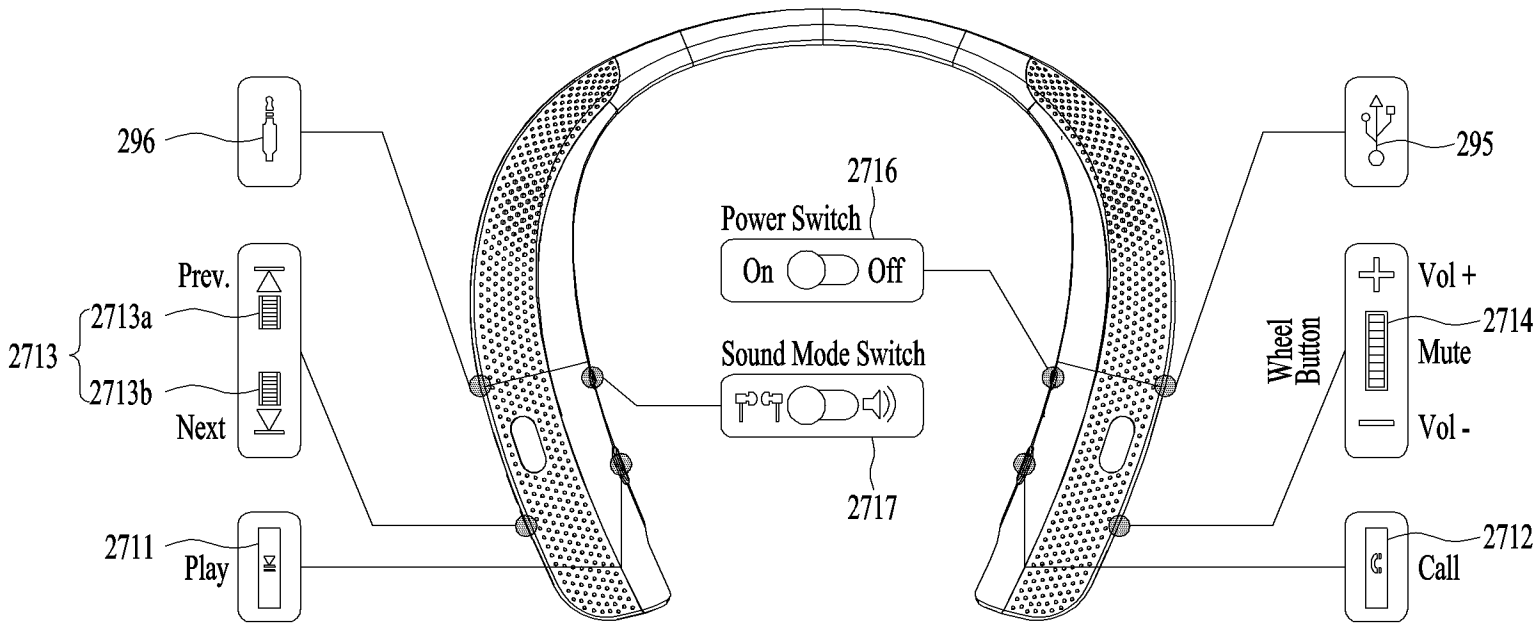
FIG. 17 is a conceptual diagram to describe a user input unit and an interface unit provided in one example of the wireless sound equipment.

FIG. 17 is a conceptual diagram to describe a user input unit and an interface unit provided in one example of the wireless sound equipment 200. The user input unit includes a first key 2711 for playing and stopping music; a second key 2712 for making and ending a call; a third key 2713 for changing or forwarding a music play list; a fourth key 2714 for controlling a sound volume; a power switch 2716 for switching on and off the power; and a sound mode switch 2717.

The first, second and third keys 2711, 2712 and 2713 may be button types which are pressable to input user commands. The fourth key 2714 may be a wheel type which is rotatable to adjust the sound volume according to a rotation direction and a rotation degree. It is possible to provide the fourth key 2714 as a button type which is pressable to input a user's command.

Two or more switches 2716 and 2717 may be provided as a state-changeable type selected from a press type and a slide type. Even in case the switches are press types, the user presses the button type keys 2711, 2712 and 2713 and the switches then restitute or the switches 2716 and 2717 keep a pressed state and restitute after re-pressed.

FIG. 18 is a diagram to describe a method of manipulating the user input unit 270 provided in one example of the wireless sound equipment 200. The switches 2716 and 2717 and the wheel-type fourth key 2714 are pushed for inputting and the button-type keys 2711, 2712 and 2713 are pressed for inputting. In this instance, the user input unit may recognize different commands according to the number of pressing times and the pressing time of the button-type keys 2711, 2712 and 2713 and control to implement different functions, respectively.

When the user presses the first key 2711 quickly, multimedia starts to play or the currently playing multimedia stops. When the user presses the first key 2711 twice in quick succession, an equalizing function is implemented for sound calibration. It is possible to implement minute calibration by using a host terminal 100 connected with the wireless sound equipment 200 wirelessly. It is also possible in the wireless sound equipment itself to select one of preset several equalizing modes.

When the user presses the third key 2713 quickly, the play order is changed to play the former track or the next track. When the user presses and holds the third key 2713, the user is provided with simple information such as the battery residual is guided or the current time is informed. Additionally, the remaining play time is displayed during the music playing or the number of a missed call is displayed. The user is able to check the current time or the simple information by pressing the third key 2713, without seeing the host terminal 100 in the flesh.

The second key 2712 is configured to implement a function related with a call. When pressing the second key 2712 quickly, the user is able to answer a call or end the call. When pressing the second key 2712 twice in quick succession, the user is able to make a call to the specified number directly. When the user presses and holds the second key 2712, a function for making a call to the most recently dialed number is able to be implemented. The functions implemented when the user presses the second key twice consecutively or presses and holds for a long time may be reversed.

The wheel-type fourth key 2714 may implement to control the sound volume as main function and turn up or down the volume according to a rotational direction. Most of the wheel is located in the housing 220 and a predetermined portion of the wheel is projected to the outside of the housing 220. The user is able to control the sound volume by pushing the projected portion or implement a specific function when pressing like a conventional button. In the embodiment, a mule function may be implemented to convert the volume of the current output sound into zero "0".

The power switch 2716 may be configured to switch on and off the power of the wireless sound equipment 200. When the power of the wireless sound equipment 200 is switched on, a preset connected host terminal 100 is retrieved directly and connected.

Hence, the sound mode switch 2717 is configured to determine the means for outputting the sound data transmitted by the wireless communication unit. It is determined according to the directions of the speakers to determine whether to output sound from the speakers 246 and 247 or the earbuds 241. Hereinafter, a state where sound is output from the earbuds 241 is referenced to as a first mode and a state where sound is output from the speakers 246 and 247 as a second mode.

Figure 19:
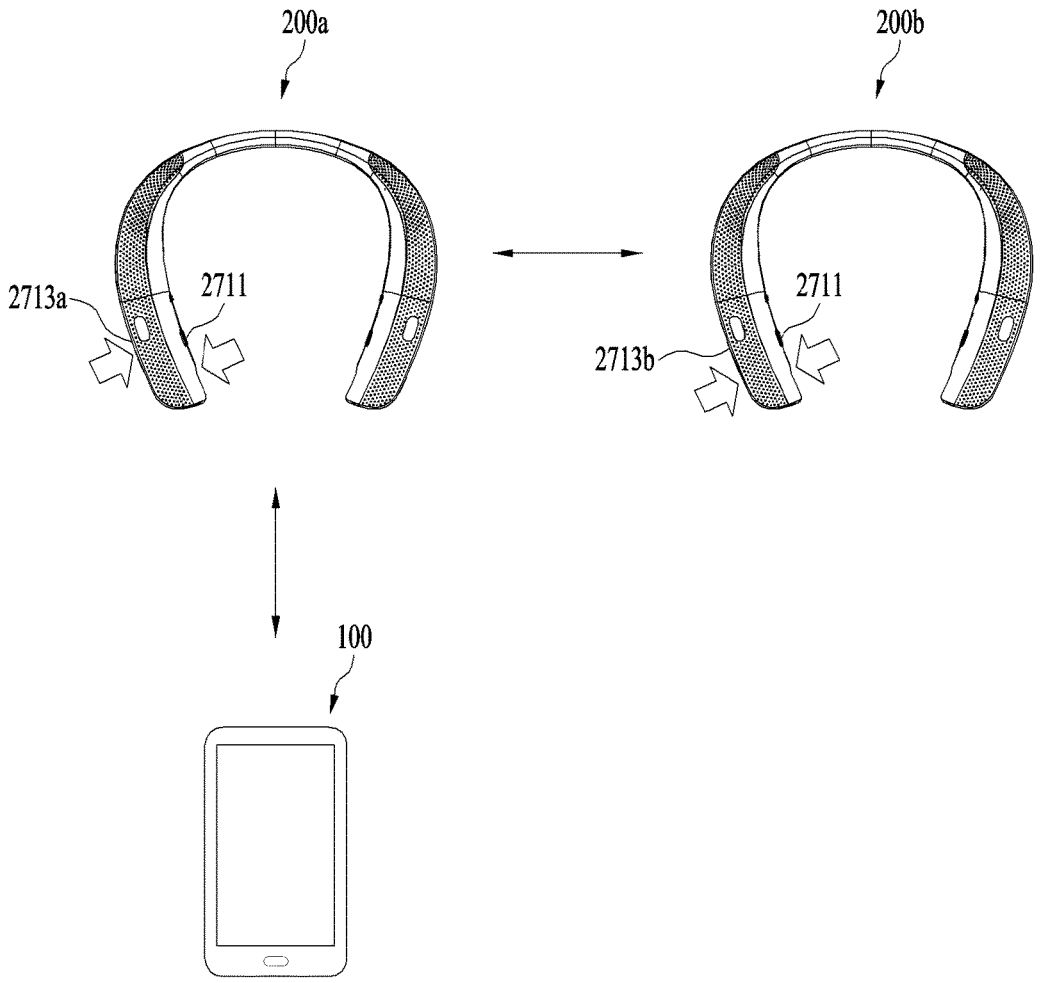
FIG. 19 is a diagram to describe TWS function provided in one example of the wireless sound equipment.

FIG. 19 is a diagram to describe TWS function of on example of the wireless sound equipment 200. The wireless sound equipment 200 functions as master to transmit the signal received from a host terminal to another wireless sound equipment 200, so as to output the same sound from the two wireless sound equipments 200 simultaneously.

True Wireless Stereo (TWS) technique is required to realize such a function. The wireless sound equipment 200 itself becomes a master device and the other second wireless sound equipment 200 becomes a slave device configured to receive a signal from the master device and output sound based on the signal. At this time, it is necessary to synchronize the master and slave devices so that the two devices can output sound simultaneously.

The wireless sound equipment 200 includes the limited input unit and no display unit and has to use a limited number of user input units for connecting the master and slave devices with each other. when the user presses the key of the third key for playing the playing the former track and the first key 2711 for playing music provided in the master device connected with the host terminal 100 simultaneously, the function as the master device is implemented to activate.

In this instance, when the user presses the key of the third key 2713 for playing the next track and the first key 2711 in the slave device simultaneously, the slave device is connected with the master device and receives sound data to play music.

Figure 20:
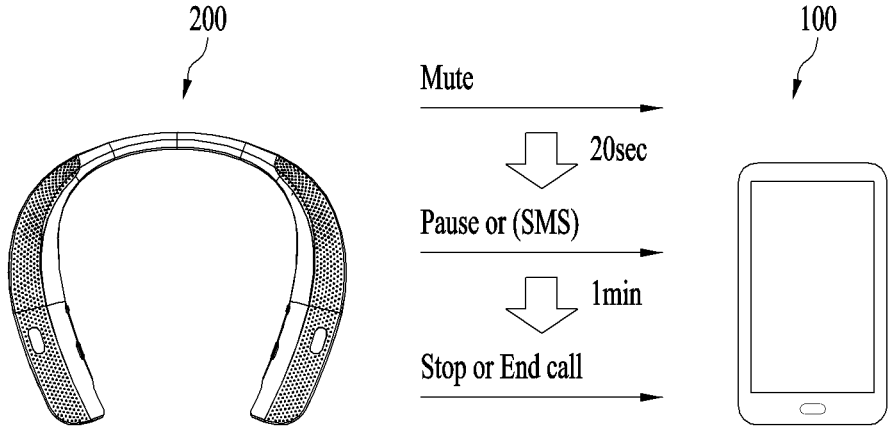
FIG. 20 is a diagram to describe a control method of a host terminal, when one example of the wireless sound equipment is mute.

FIG. 20 is a diagram to describe a control method of the host terminal 100 when the wireless sound equipment 200 is in a mute state. The wireless sound equipment 200 of the present disclosure may be connected with the host terminal 100. In the drawing, the host terminal 100 is shown only as a smart phone and examples of the host terminal 100 may further include a TV, a notebook computer and other diverse multimedia devices.

The sound of the multimedia playing in the host terminal 100 is output from the speakers 246 and 247 or the earbuds 241 of the wireless sound equipment 200. In case the host terminal 100 is used in talking on the phone, the voice from the other side of the call is transmitted and output and the user's voice is collected by the microphone 260 of the wireless electronic equipment, only to transmit the collected voice to the host terminal 100.

In case the host terminal 100 performs the call function, Head Set Profile (HSP) or Hands Free Profile (HFP) may be used as wireless communication between the wireless sound equipment 200 and the host terminal. In case the host terminal plays multimedia, one of Advanced Audio Distribution Profile (A2DP), Audio/Video Remote Control Profile), Human Interface Device (HID) may be used in performing wireless communication between the wireless sound equipment 200 and the host terminal.

HSP and HFP are profiles for headsets and hands-free and in communication with a call function of a mobile phone. HSP is capable of transmitting a call voice and HFP is capable of providing remote control functions for re-dial, voice-dial, call answering and call ending and applied to heads-set for call or a hands-free system for a vehicle. In this instance, HSP and HFP are the profiles for calls and configured to output a mono sound with 64 kbit/s of a sound quality, so that they may be inappropriate as music play profiles.

A2DP is Bluetooth profile for supporting stereo audio. Headsets for music appreciation by Bluetooth and the host terminal basically support A2DP. AVRCP supports the adjusting of music playing such as music playing, music stopping, the next track playing and the former track playing, like HFP supporting the manipulation of the call function.

A2DP is designed to transmit 2 channel stereo audio and enables music playing in a MP3 player or smart phone from Bluetooth headsets or earphones. Different from HSP and HFP profiles used in a voice call, A2DP provides a high-quality stereo sound and the best function optimized for appreciating music as a one-step evolved profile technique in comparison with AVRCP which is the first profile providing conventional stereo sound quality. There is not delay in delivering sound between the two earbuds 241 and there is no problem of contradicted sounds provided by the two earbuds 241.

HID is a Bluetooth communication profile communicating with a peripheral device capable of receiving the user's input or output and applicable to a user manipulation device such as a mouth, a keyboard and a controller. HID is embodied as a USB-like type and applied to a wireless keyboard, a wireless mouth and a wireless game controller.

In case the host terminal 100 is implemented to pause the current call or the currently playing music temporarily, a mute function of the wireless sound equipment 200 may activate. As mentioned above, the fourth key 2714 may be pressed to activate the mute function.

There is no problem when releasing after activating the mute function. When the mute function has to activate for a relatively long time, the multimedia is being consecutively played in the host terminal 100 so that the user has to find out the paused point later and re-play the music inconveniently. During the talking on the phone, the other opponent of the call has to wait disadvantageously.

To solve the disadvantage and inconvenience, the user may be consecutively informed the mute state, using a vibration or a sound. When the mute state is contained for a preset time period (for example, 30 minutes) or more, the currently playing multimedia is paused and a message telling the other opponent to wait a moment is sent. Unless the mute state is released for the preset time period (for example, 1 minute) or more, the currently playing multimedia is end or a signal is sent to the host terminal 100 to end the currently being used call.

Especially, in case of being on the phone, a control signal may be transmitted to the host terminal 100 to disconnect the call after sending a message telling the other opponent of the call to call back later to give a call later again, so that the other side of the call may not wait indefinitely or he or she may have an unpleasant disconnection. Although the control method is described in two steps, it may be set to end the currently playing multimedia or the talking with the other side of the call without the intermediate step when a preset time period (for example, 30 minutes) passes.

Figure 21:
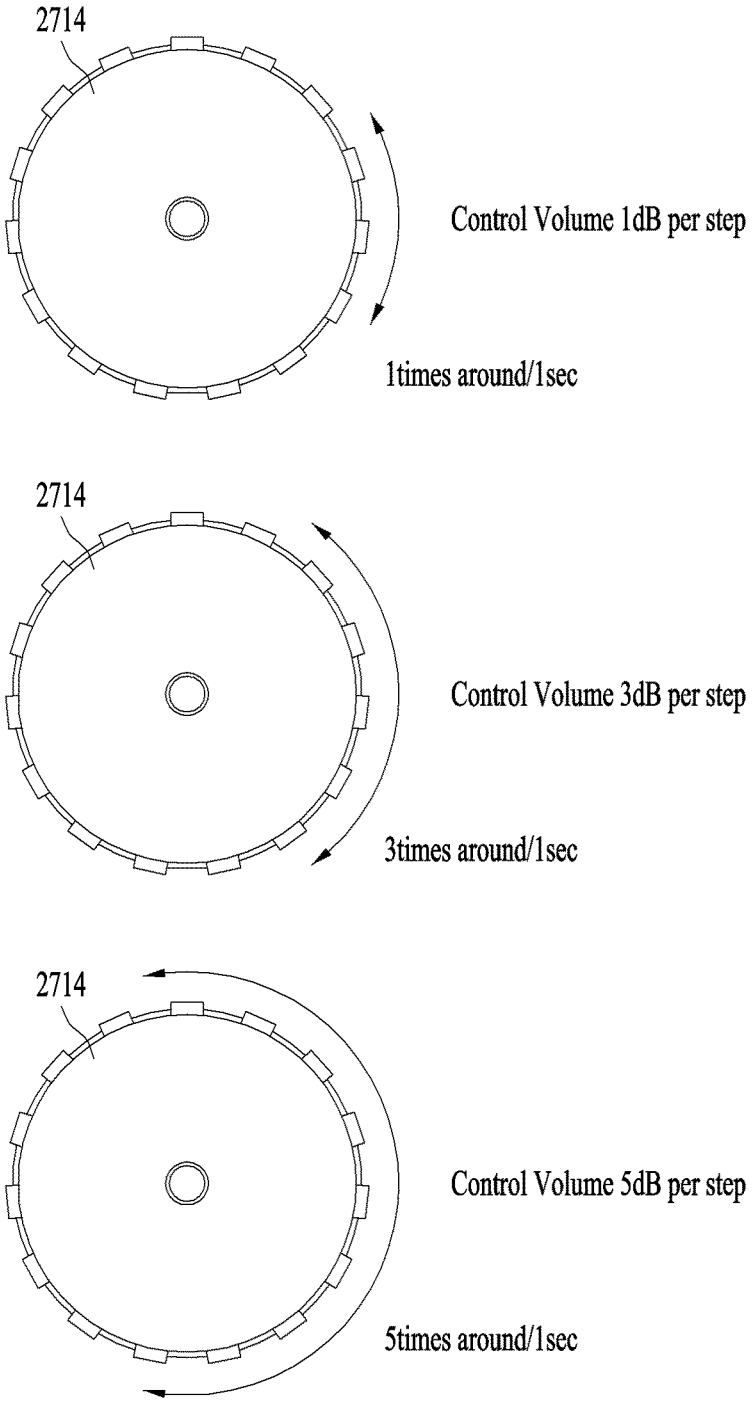
FIG. 21 is a diagram to describe an operation method of a sound control wheel provided in one example of the wireless sound equipment.

FIG. 21 is a diagram to describe a method for manipulating the sound volume wheel provided in one example of the wireless sound equipment 200. The wireless sound equipment includes both a speaker mode and an earbud mode. A range of volume levels adjustable in the speaker mode is different from a range volume levels adjustable in the earbud mode. The maximum volume of the speaker mode is higher than that of the earbud mode, so that the volume levels of the speaker mode can be subdivided to control the volume in very subtle ways. In other words, the volume is controlled in the earbud mode and the speaker mode based on a different table.

The volume control of the present disclosure may be adjustable by using the wheel-type fourth key 2714 and the volume control may be adjusted according to a rotational angle speed of the wheel-type fourth key 2714. When trying to control the volume to large increase, the user has to rotate the wheel far to adjust the volume. In case the volume levels are adjustable from 0 dB to 32 dB by each 2 dB in one step, the user has to rotate the wheel-type key past 32 steps so as to adjust the volume to the highest level from the lowest level. If the volume levels are adjustable by each 3 dB or 5 dB in one step, it might be impossible to adjust the volume subtly.

Accordingly, the volume control may be controlled for the size of the sound adjustable per one step to be differentiated according to the rotation speed of the wheel, in case desired to change the quick volume level while enabling the subtle volume control. When the user rotates the wheel slowly, the volume level is changed each 2 dB per one step in 32 steps. When the rotation speed is fast, the volume level is changed to have a large sound volume range which changes each 2 dB or 4 dB per one step. Accordingly, the volume level is able to reach the highest level only past 16 steps or 8 steps.

At this time, the speaker mode is different from the earbud mode in the maximum volume. In the subtly fine adjustment of the volume levels, different volume level steps are set in each of the speaker mode (hereinafter, a first mode) and the earbud mode (hereinafter, a second mode) and the speaker mode may have more subdivided steps for the user to adjust the volume levels in more subdivided steps.

Figure 22:
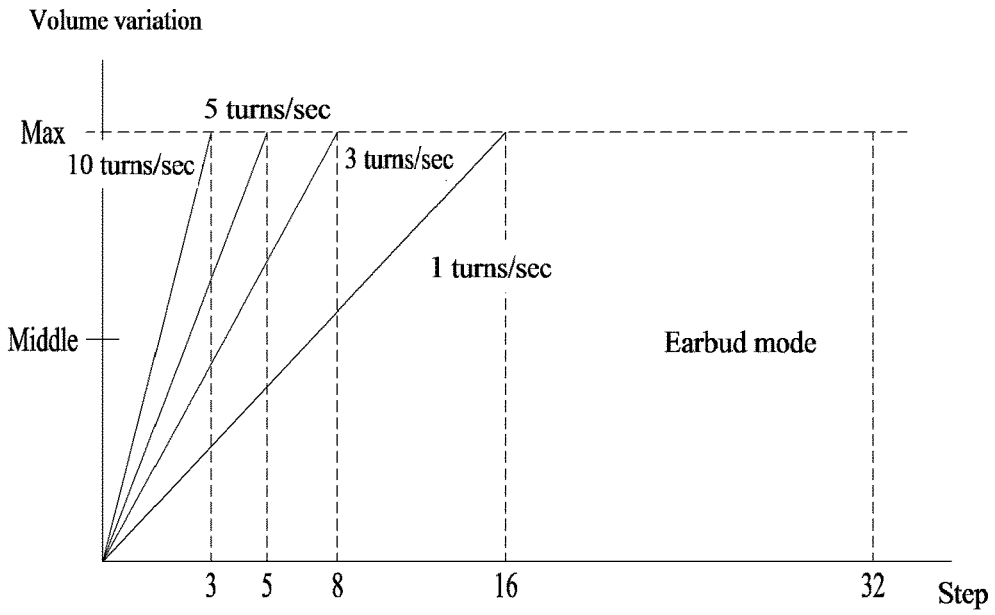
FIG. 22 is a diagram to describe one example of a sound control method in a first mode and a second mode.
Figure 22:
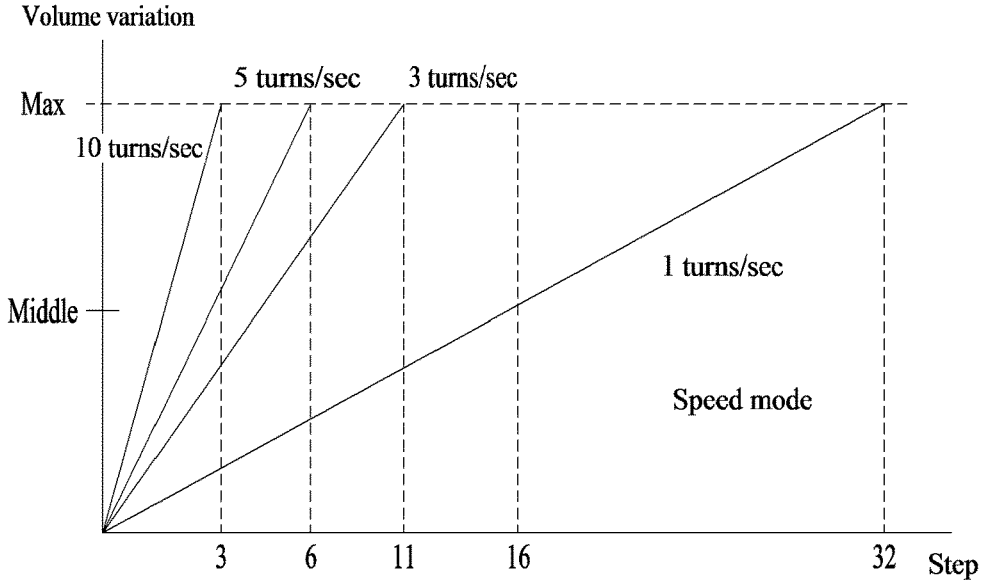

FIG. 22 is a diagram to describe one embodiment of the volume control method in the first mode and the second mode. Numerical values shown in FIG. 22 are examples and steps may be more subdivided or variations may be set different according to the rotation speed. In the earbud mode, the volume control is adjustable from 1 dB to 16 dB. In the speaker mode, the volume control is adjustable from 0 dB to 32 dB. When each one step is set to raise 1 dB, the first mode may have 16 steps of the volume control and the second mode may have 32 steps of the volume control.

When the user rotates the wheel slowly (at a speed of one turn/second), the volume control is adjustable in basic-set steps. When trying to adjust the volume to a large level as mentioned above, the user rotates the wheel quickly. For example, the wheel is rotated at a preset speed or higher, for example, 3 turns per 1 second, the entire volume levels of the first mode include 8 steps and the entire volume levels of the second mode include approximately 11 steps. The volume of the first mode rises 2 dB per one step and the volume of the second mode rises 3 dB per one step.

When the user rotates the wheel more quickly at a speed of 5 turns per second, the entire volume levels of the first mode include approximately 5 steps and the entire volume levels of the second mode include approximately 6 steps. The volume of the first mode rises 3 dB per one step and the volume of the second mode rises 5 dB per one step. When the fourth key 2714 is rotated at a speed of 10 turns per one second, the entire volume levels of the first mode include 3 steps and the entire volume levels of the second mode include approximately 3 steps. The volume of the first mode rises 5 dB per one step and the volume of the second mode rises 10 dB per one step.

More specifically, the size of the volume adjusting in each one step is differentiated according to the rotation speed of the fourth key 2714 so that the volume control may be adjusted quickly or subtly enough to promote the user convenience.

Figure 23:
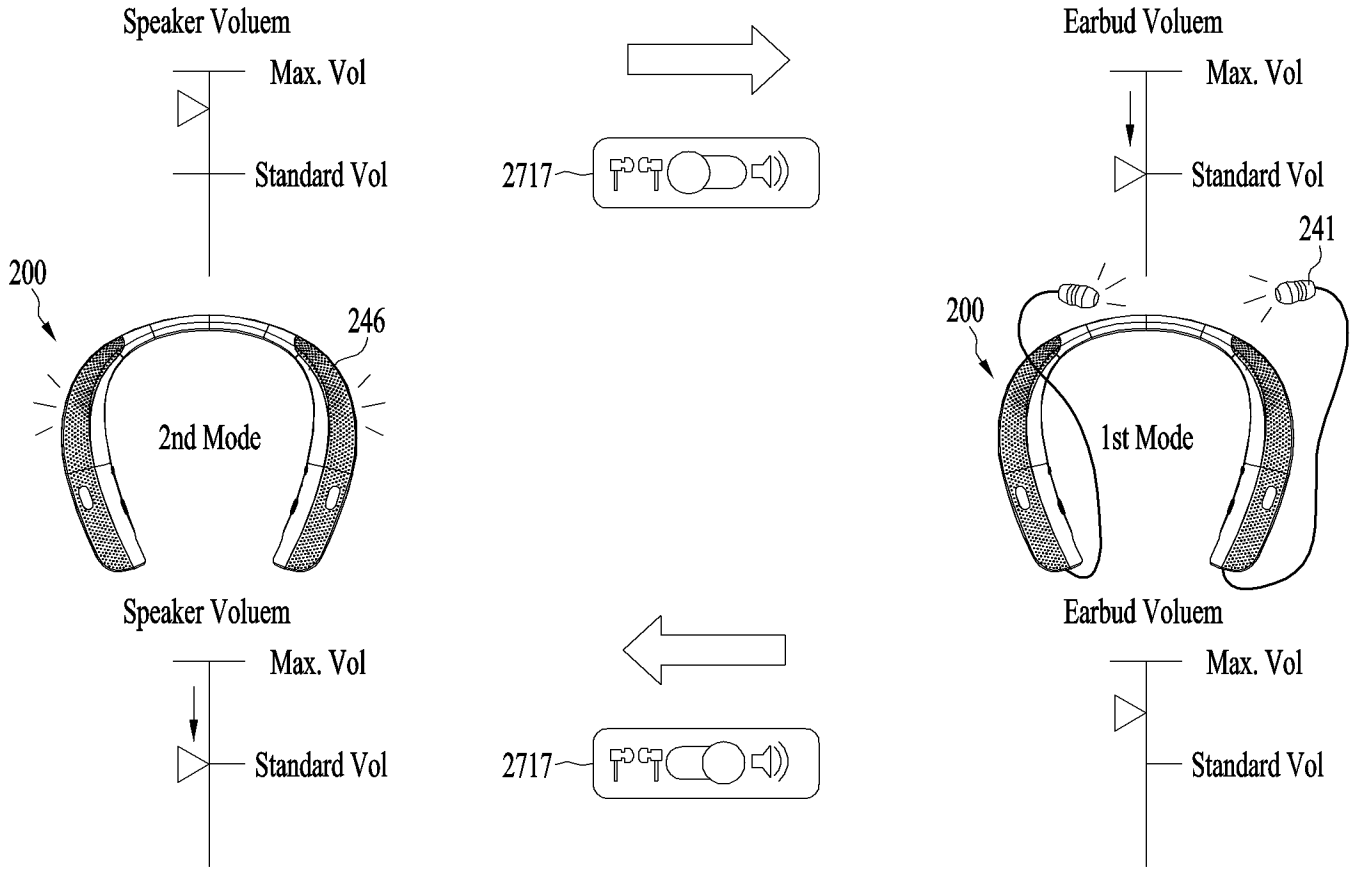
FIG. 23 is a diagram to describe a sound control method when a mode is converted between speakers and an earbud of one example of the wireless sound equipment.

FIG. 23 is a diagram to describe a method for controlling the volume in changing a mode between the speakers 246 and 247 and the earbuds 241 provided in one example of the wireless sound equipment 200. There is a difference of a volume range between the speaker 246 and the earbud 241. The maximum volume of the sound output from the earbud 241 wearable on the user's ear may be set to be smaller than that of the speaker 246 and 247. The volume control in the first mode and the second mode may be performed in a different sound size when the wheel is rotated one step.

The first mode (the earbud mode) may be converted into the second mode (the speaker mode) and vice versa, using a sound mode switch. When the second mode is converted into the first mode, the speakers 246 and 247 are configured to output no sound to the ears directly and the earbuds 241 are configured to output sound to the ears directly. If loud sound is suddenly output to the ears directly, there is concern of hearing impairment. Accordingly, the volume level is converted into a standard volume level at the same time as the second mode is converted into the first mode.

In contrast, when sound is being output in the first mode at the standard volume level or higher in case the first mode is converted into the second mode, the current volume level may be converted into the standard volume level for the speakers 246 and 247 not to output loud sound suddenly.

Figure 24:
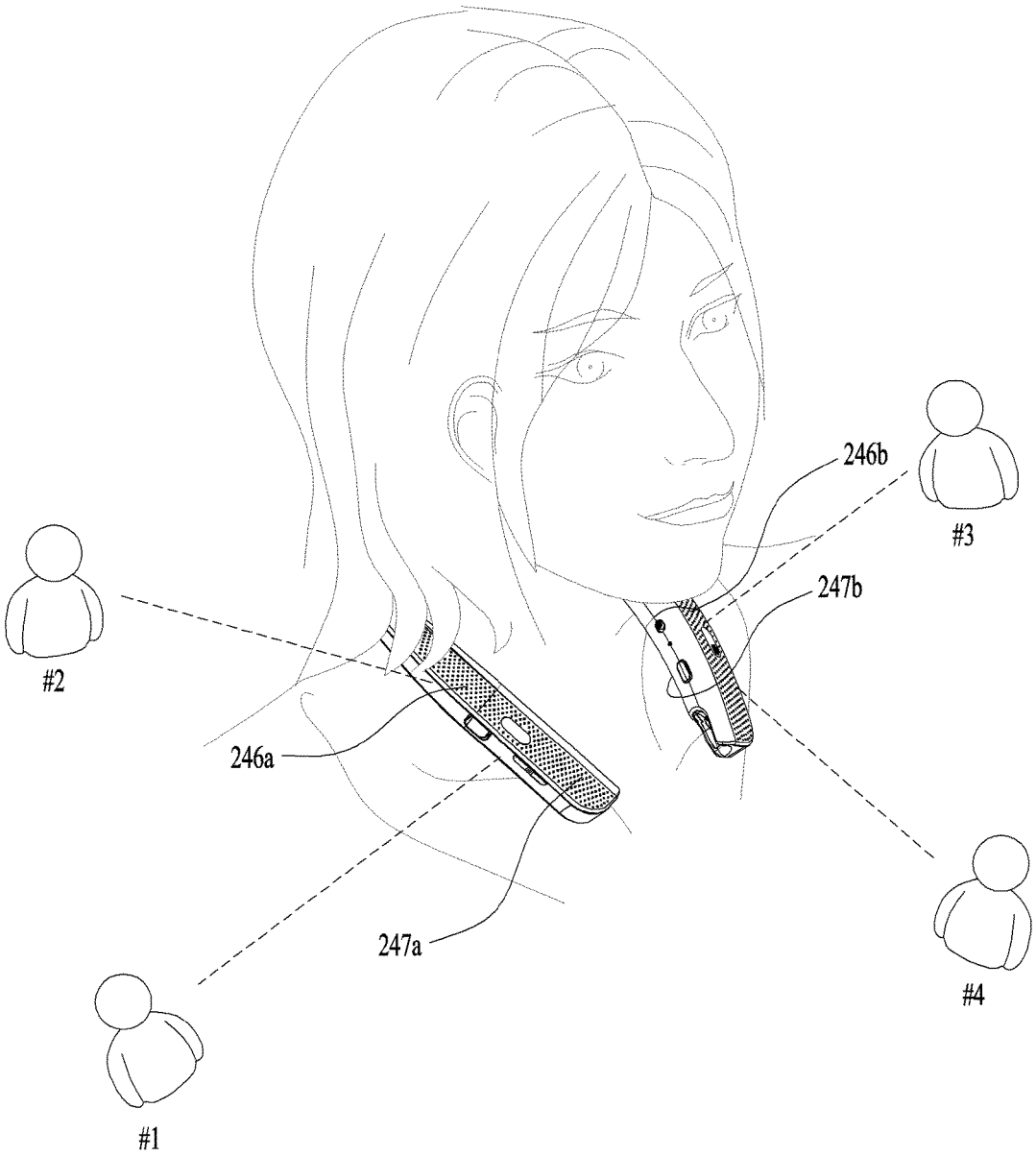
FIG. 24 is a diagram to describe a method for performing a conference call, using four speakers of one example of the wireless sound equipment.

FIG. 24 is a diagram to describe a method for performing a conference call function using the four speakers 246 and 247 provided in one example of the wireless sound equipment 200. Once making a conference call, the user starts a conference meeting with the other several sides of the call as conference members on the phone and it is difficult to distinguish the conference member from each other. To solve the difficulty, the speakers 246 and 246 may be configured to output the other opponents' voices, respectively, so that the other opponents' voices are given directivity to be distinguished from each other.

The present disclosure uses the four speakers 246*a*, 246*b*, 247*a* and 247*b*. In case the other opponents of the conference call are four members, the four speakers 246*a*, 246*b*, 247*a* and 247*b* are controlled to output their voices, respectively. In case the other opponents are more than four, the speakers may be controlled to output the four opponents' voices and output the other two opponents' voices added in another direction by combining two of the speakers.

To distinguish the other opponents on the conference call from each other, a voice delimiter is transmitted in a state of being included in each voice. An application installed in the host terminal 110 is implemented to control the host terminal to transmit each voice signal provided with a voice delimiter.

The voice delimiter may be designated for the other opponent on the conference call according to a group of the other opponents (for example, a coworker group and a work position group). The user is able to select the speaker for outputting the voice by designating a voice delimiter on the application and the difficulty may be solved in distinguishing members of the group having a similar voice from each other on the conference call or a new member is in the group on the conference call.

The wireless sound equipment 200 includes both the speakers 246 ad 247 and the earbuds 241 and it is capable of noticing the specific event to the user in diverse ways, when a specific even is generated. The conventional way of noticing an alarm to the user through the vibration generated in a vibration module is developing to a new way of noticing the alarm to the user through the speakers. The other opponent for an important call may be. In this instance, when the user gets a call or a text message from the preset number as the important call, the call or text message is noticed to the user by adjusting the speakers 246 and 247 not to miss the notice. Regardless of the setting of the mode switch 2717, an alarm sound may be transmitted to the speakers 246 and 247. Together with the notice, the name of the other opponent on the call is included in the transmitted alarm sound. The user may identify the other opponent on the call, without seeing checking the host terminal 100.

Moreover, diverse alarm ways may be used according to types of events. The second speakers 247 are capable of providing vibration as well as sound and then providing the user with a notice instead of vibration motor. The second speakers 247 are located in right and left sides, respectively, so that one second speaker 247*a* can provide the user with an alarm notice of a text message and the other second speaker 247*b* can provide the user with an alarm notice of the other application advertisements and the like.

Figure 25:
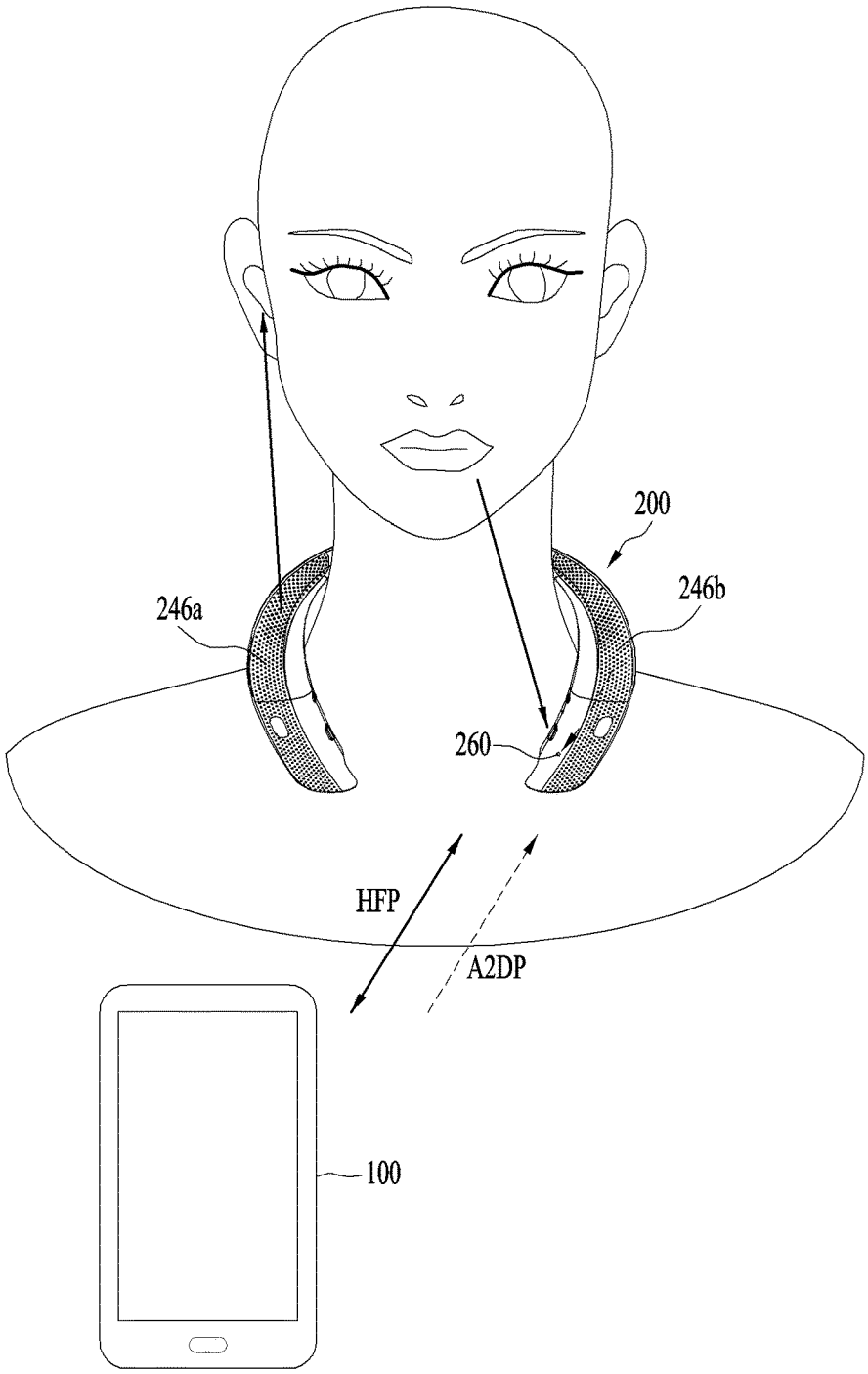
FIG. 25 is a diagram to describe a communication method between a host terminal and one example of the wireless sound equipment.

FIG. 25 is a diagram to describe a communication method between the host terminal 100 and one example of the wireless sound equipment 200. As mentioned above, the wireless sound equipment 200 may make a call by HFP and output multimedia sound by A2DP.

In case the microphone 260 is too close to the speakers 246*b* and 247*b* when outputting sound in the speaker mode during the call, the other opponent' voice on the call is input to the microphone 260 as it is and the voice is re-transmitted to the other opponent on the call, which is called 'echo'. To prevent the echo, the other opponent's voice on the call is output not from the speakers 246*b* and 247*b* located in the housing 220 together with the microphone 260 but from the speakers 246*a* and 247*a* located in the other housing 220.

Moreover, multimedia may be output from the speakers 246*b* and 247*b* not used during the call. Background music or sound may be transmitted to the other opponent during the call so that various situations can be created. The multimedia receives data by A2DP and the call receives data by HFP. The multimedia and the call transceive data by the different methods, respectively, only to be performed simultaneously.

In case of performing simultaneous interpretation by using a mobile terminal having a translating function, the wireless sound equipment 200 may translate the user's voice and the other opponent's voice by using two speakers. At this time, the interpreted text of the other opponent's voice is output from the left speakers 246*a* 247*a* and the interpreted text of the user's voice is output from the right speakers 246*b* and 247*b*, only to output user's spoken dialogue and the other opponent's spoken dialogue simultaneously and facilitate endless conversation.

As mentioned above, the wireless sound equipment 200 of the present disclosure may include the speakers which facing different directions, respectively. Accordingly, the wireless sound equipment 200 is capable of providing 3D surround sound. Especially, the vibration speaker located toward the user's body may output vibration as well as sound so as to deliver more vivid sound to the user.

Furthermore, the enclosure 248 having the speakers 246 and 247 located therein may expand the resonance space, not additionally increasing the space. Accordingly, the sound quality of the speakers 246 and 247 may be enhanced and the structure configured to locate the second hole 227 of the housing 220 in close contact with the user's body may be realized so that the user can directly feel the vibration from the second speakers 247.

Still further, the plurality of the speakers are driven differently and independently and capable of outputting the sounds with directivity, not affecting the microphones 260. Accordingly, the sound quality of the microphone 260 may be enhanced.

The foregoing embodiments are merely exemplary and are not to be considered as limiting the present disclosure. The present teachings can be readily applied to other types of methods and apparatuses. This description is intended to be illustrative, and not to limit the scope of the claims.

What is claimed is:

1. A wireless sound equipment comprising:

a body having an upper portion and a lower portion, the body being configured to be worn around a neck of a user with the upper portion directed upwardly toward ears of the user and the lower portion directed downwardly toward shoulders of the user;

an internal space located in the body and forming an enclosure;

a partition wall partitioning off the internal space into a first accommodating portion and a second accommodating portion, wherein the first accommodating portion and the second accommodating portion are arranged side by side in the horizontal direction;

a first hole located in the upper portion of the body corresponding to the first accommodating portion;

a first speaker located in the first accommodating portion and arranged toward the first hole so as to output sound via the first hole;

a second hole located in the lower portion of the body corresponding to the second accommodating portion;

a second speaker located in the second accommodating portion and arranged toward the second hole so as to output sound via the second hole; and a through-hole provided in the partition wall, the through-hole permitting the first accommodating portion and the second accommodating portion to communicate with each other, wherein the through-hole enables the first speaker to use the first accommodating portion and the second accommodating portion as a resonance space, and the second speaker to use the first accommodating portion and the second accommodating portion as a resonance space, and wherein the partition wall reduces the resonance space of the first speaker and the second speaker, and prevents an eddy from forming due to an air flow vibrated by the first speaker and an air flow vibrated by the second speaker meeting directly.

2. The wireless sound equipment of claim 1, wherein the first hole is located outwardly farther than the second hole in a right-and-left direction with respect to a centerline of the user when the body is located around the neck of the user.

3. The wireless sound equipment of claim 1, wherein the first hole is located rearwardly of a vertical line passing through an ear hole of the user when the body is located around the neck of the user, and the second hole is located forwardly of the vertical line when the body is located around the neck of the user.

4. The wireless sound equipment of claim 1, further comprising:

a wireless communication unit located in the body and connectable to a host terminal to transmit data and receive data, the data received including direction information; and a controller configured to control output from the speakers in different directions corresponding to the direction information.

5. The wireless sound equipment of claim 4, the body further comprising a first housing and a second housing, the first housing and the second housing being located at right and left sides, respectively, of the user when the body is located around the neck of the user, wherein the first hole, the first speaker, the second hole, and the second speaker are provided in each one of the first housing and the second housing; and a microphone located in the first housing, wherein the controller is further configured to control the speakers located in the second housing to output sound and deactivate the speakers located in the first housing when sound is input to the microphone.

6. The wireless sound equipment of claim 5, wherein the wireless communication unit is configured to perform wireless communication by Advanced Audio Distribution Profile (A2DP) and Hands Free Profile (HFP), and wherein the controller is configured to control the speakers located in the second housing to output designated sound.

7. The wireless sound equipment of claim 1, wherein the second hole is configured to contact the user when the body is located around the neck of the user.

8. The wireless sound equipment of claim 1, wherein the body further comprises a bent portion located between the first hole and the second hole, and wherein the first speaker and the second speaker are arranged in the body such that the second speaker is oriented in a more vertical direction than the first speaker when the body is located around the neck of the user.

9. The wireless sound equipment of claim 1, wherein the body further comprises a housing and a speaker frame, at least one of the first speaker and the second speaker being located in the speaker frame, and wherein an angle and/or a location of the speaker frame is variable with respect to the housing.

10. The wireless sound equipment of claim 1, wherein the through-hole is arranged in the partition wall along a line passing through a center of the second speaker.

11. The wireless sound equipment of claim 1, wherein a gradient formed in a bottom surface of the first accommodating portion is different from a gradient formed in a bottom surface of the second accommodating portion.

12. The wireless sound equipment of claim 11, further comprising:

a boss extended from the enclosure in a thickness direction of the enclosure; and a fastener inserted into the boss, wherein the boss extends in a direction non-perpendicular with the bottom surface of the second accommodating portion.

13. The wireless sound equipment of claim 1, wherein the enclosure comprises an enclosure housing in which the first speaker and the second speaker are located, and wherein a lower portion of the enclosure housing is thinner than an upper portion of the enclosure housing.

14. The wireless sound equipment of claim 1, further comprising a speaker seating rib projected from a lower surface of the enclosure at a circumference of the second hole.

15. The wireless sound equipment of claim 1, wherein the enclosure further comprises a rubber sheet attached to an upper surface and a lower surface of the enclosure, and wherein the rubber sheet comprises one or more cut-away slits.

16. The wireless sound equipment of claim 1, wherein the body further comprises:

a first housing and a second housing, the first housing and the second housing being located at right and left sides, respectively, of the user when the body is located around the neck of the user; and a band connecting the first housing to the second housing, wherein the first hole, the first speaker, the second hole, and the second speaker are provided in each one of the first housing and the second housing.

17. The wireless sound equipment of claim 16, further comprising:

an enclosure located in the body, the enclosure accommodating the first speaker and the second speaker therein; and a shape memory alloy embedded in the band, the shape memory alloy having ends penetrating into the enclosure.

18. The wireless sound equipment of claim 16, wherein a weight of a center portion including the band and a weight of end portions including the first housing and the second housing are symmetrically balanced with respect to a line passing through the second hole in the first housing and the second hole in the second housing.

19. The wireless sound equipment of claim 16, further comprising:

an earbud holder provided at one end of the body;

an earbud configured to be coupled to the earbud holder;

a cable hole provided in the earbud holder;

a rotation module provided in the body and located adjacent to the cable hole; and a sound cable passing through the cable hole, the sound cable having a first portion wound around the rotation module and a second portion connected to the earbud, wherein the rotation module and the earbud holder are overlapped with each other in a width direction of the body.

20. The wireless sound equipment of claim 19, wherein the cable hole is located along a line tangential to a point on the rotation module where the sound cable becomes unwound from the rotation module.

21. The wireless sound equipment of claim 1, wherein the first speaker has a rectangular or oval shape with a long axis and a short axis, and wherein the second speaker has a circular shape, the second speaker comprising a vibration speaker configured to output a low frequency signal.

22. The wireless sound equipment of claim 1, further comprising:

a wireless communication unit located in the body and connectable to a host terminal to transmit data and receive data;

a sound cable connected with the body;

an earbud connected to an end of the sound cable, the earbud configured to output sound;

a sound mode switch configured to permit the user to select a first mode to output data via the earbud, and a second mode to output data via the first speaker and the second speaker; and a controller configured to control the earbud, the first speaker and the second speaker to output the data transmitted by the wireless communication unit based on a state of the sound mode switch.

23. The wireless sound equipment of claim 22, wherein the controller is configured to lower an output volume level to a preset volume level if the sound output via the earbud or the first or second speaker is higher than a preset volume level and the controller senses that the mode of the sound mode switch is changed.

24. The wireless sound equipment of claim 22, further comprising a volume key configured to adjust a volume output via the earbud or the first or second speaker, wherein the controller adjusts volume levels of the earbud and the first and second speakers for a range of volume levels and steps that are adjustable by the volume key to be different in the first mode from the second mode.

25. The wireless sound equipment of claim 22, wherein the controller is configured to output sound via the first or second speaker, regardless of a state of the sound mode switch, when receiving information about a generation of a preset event from the wireless communication unit.

26. The wireless sound equipment of claim 1, further comprising:

a wheel-type volume key for adjusting a volume of sound output from the first speaker or the second speaker; and a controller configured to adjust a variation of the volume according to a rotation speed of the volume key such that when a rotation speed of the volume key is high, an amount of change of the volume per unit angle turned is large, and when the rotation speed of the volume key is low, the amount of change of the volume per unit angle turned is small.

27. The wireless sound equipment of claim 1, further comprising:

a mute key for implementing a mute mode to stop an output of sound; and a controller configured to transmit a signal for stopping the playing of music or ending a call to a host terminal, unless the mute mode is released within a preset time period after the mute key is activated.

28. The wireless sound equipment of claim 1, further comprising:

a wireless communication unit located in the body and connectable to a host terminal to transmit data and receive data, the wireless communication unit being connectable with a slave wireless communication unit of a slave sound equipment to transmit sound data received from the host terminal; and a controller configured to control sound output via the first speaker and the second speaker and to control sound output via the slave sound equipment.

* * * * *